US010125525B2

(12) United States Patent
Presutti

(10) Patent No.: US 10,125,525 B2
(45) Date of Patent: Nov. 13, 2018

(54) DOOR BARRICADE

(71) Applicant: Michael Presutti, Chester, NJ (US)

(72) Inventor: Michael Presutti, Chester, NJ (US)

( * ) Notice: Subject to any disclaimer, the term of this patent is extended or adjusted under 35 U.S.C. 154(b) by 0 days.

(21) Appl. No.: 15/589,086

(22) Filed: May 8, 2017

(65) Prior Publication Data

US 2017/0241173 A1 Aug. 24, 2017

Related U.S. Application Data

(63) Continuation-in-part of application No. 14/765,330, filed as application No. PCT/US2014/014340 on Feb. 1, 2014, now Pat. No. 9,644,408.

(Continued)

(51) Int. Cl.
*E05C 3/06* (2006.01)
*E05C 19/00* (2006.01)

(Continued)

(52) U.S. Cl.
CPC ..... *E05C 19/005* (2013.01); *E05B 45/06* (2013.01); *E05B 47/0001* (2013.01); *E06B 5/10* (2013.01);

(Continued)

(58) Field of Classification Search
CPC ..... E05C 19/005; E06B 5/10; E05B 47/0001; E05B 45/06; E05B 2045/0695; E05B 2047/0086; A62C 13/78

(Continued)

(56) References Cited

U.S. PATENT DOCUMENTS 327,373 A 9/1885 Yarnall et al.
1,157,863 A * 10/1915 Hamelin ..... E05B 45/06 340/542

(Continued)

FOREIGN PATENT DOCUMENTS

DE 9407569 7/1994
DE 29602750 5/1996

(Continued)

OTHER PUBLICATIONS

Barracuda Products, http://www.bilco.com/foundations/store/storepage.asp?page=products Jul. 9, 2014.

*Primary Examiner* — Jerry E Redman
(74) *Attorney, Agent, or Firm* — Hodgson Russ LLP

(57) ABSTRACT

Barricade devices and methods of barricading a door are disclosed. Such devices and methods may be used to barricade a door, and thereby prevent an intruder from entering a sheltering space, such as a classroom, storeroom, or hallway. The barricade-device may have a pivotable stop-device that is pivotable from a location adjacent to a door. The pivot-location may be at an elevation that is lower than a door handle on the door. The stop-device may be pivotable from a reserve-position to a stop-position. In the reserve-position, the stop-device does not barricade the door. In the barricade-position, the stop-device barricades the door. Operation of the barricade-device may require the use of one or more major muscle groups of the body, but need not require precise dexterity of the fingers or hands (e.g. such as that required to manipulate small keys, latches, and/or the grasping and turning of assemblies). As such, the barricade-device may be used properly and quickly by a wide range of people having differing physical and mental capabilities.

24 Claims, 20 Drawing Sheets

Related U.S. Application Data

(60) Provisional application No. 61/759,951, filed on Feb. 1, 2013.

(51) Int. Cl.
*E05B 47/00* (2006.01)
*E06B 5/10* (2006.01)
*E05B 45/06* (2006.01)
*A62C 13/78* (2006.01)

(52) U.S. Cl.
CPC ..... *A62C 13/78* (2013.01); *E05B 2045/0695* (2013.01); *E05B 2047/0086* (2013.01)

(58) Field of Classification Search
USPC ..... 292/201, 288, 289, 297, 338, DIG. 12, 292/DIG. 15, DIG. 25
See application file for complete search history.

(56) References Cited

U.S. PATENT DOCUMENTS

| | | | | |
|---|---|---|---|---|
| 1,394,278 | A | 10/1921 | Cirac | |
| 2,421,275 | A | 5/1947 | Garcia | |
| 3,592,497 | A | 7/1971 | Logan, Jr. | |
| 3,819,216 | A | 6/1974 | Richardson | |
| 3,865,426 | A | 2/1975 | Barnhart | |
| 3,980,328 | A | 9/1976 | Pearson | |
| 4,067,598 | A | 1/1978 | Mansour | |
| 4,291,645 | A | 9/1981 | Cruchelow et al. | |
| 4,293,541 | A | 10/1981 | Cairns | |
| 4,349,223 | A | 9/1982 | Spector | |
| 4,431,044 | A | 2/1984 | Bruneau | |
| 4,634,158 | A | 1/1987 | Jones | |
| 4,788,746 | A | 12/1988 | Idler | |
| 5,253,905 | A | 10/1993 | Hutson | |
| 5,282,656 | A | 2/1994 | Fizer | |
| 5,447,046 | A | 9/1995 | Duffus | |
| 5,447,345 | A * | 9/1995 | Daley | E05C 19/003 292/259 R |
| 5,452,929 | A * | 9/1995 | Anderson | E05C 19/003 292/259 R |
| 5,473,841 | A | 12/1995 | Grillo | |
| 5,791,173 | A | 8/1998 | Montes | |
| 6,032,329 | A | 3/2000 | Casali | |
| 6,149,209 | A * | 11/2000 | Barton | E05C 5/00 292/189 |
| 6,481,252 | B2 | 11/2002 | Calle et al. | |
| 6,758,076 | B1 * | 7/2004 | Åsen | E05B 63/24 292/259 R |
| 7,026,932 | B2 | 4/2006 | Loudon | |
| 7,235,059 | B2 | 6/2007 | Mason et al. | |
| 7,537,251 | B1 | 5/2009 | Profita | |
| 7,637,130 | B2 | 12/2009 | Carr | |
| 7,770,420 | B2 | 8/2010 | Carr | |
| 7,814,706 | B2 | 10/2010 | Gamache | |
| 8,459,704 | B2 | 6/2013 | Daniels | |
| 8,727,400 | B1 | 5/2014 | Marchand | |
| 8,782,935 | B2 | 7/2014 | Forehand | |
| 9,243,431 | B1 | 1/2016 | DeLeon | |
| 9,644,408 | B2 * | 5/2017 | Presutti | E05C 19/005 |
| 2002/0007655 | A1 | 1/2002 | Calle | |
| 2003/0067176 | A1 | 4/2003 | Stevens | |
| 2006/0279093 | A1 * | 12/2006 | Tang | E05C 17/166 292/288 |
| 2007/0000293 | A1 | 1/2007 | Daniels et al. | |
| 2007/0205703 | A1 | 9/2007 | McLuckie | |
| 2010/0127517 | A1 | 5/2010 | Bliding et al. | |
| 2011/0011138 | A1 | 1/2011 | MacFarland | |
| 2011/0304164 | A1 | 12/2011 | Salo et al. | |
| 2012/0297684 | A1 | 11/2012 | Bresson et al. | |
| 2012/0326457 | A1 | 12/2012 | Mead | |
| 2015/0184436 | A1 * | 7/2015 | Caruso | E05C 19/005 292/338 |
| 2017/0321453 | A1 * | 11/2017 | Zheng | E05B 55/06 |

FOREIGN PATENT DOCUMENTS

| | | |
|---|---|---|
| DE | 202006008723 | 8/2006 |
| FR | 2570751 | 3/1986 |
| GB | 2363421 | 12/2001 |

* cited by examiner

DOOR BARRICADE

CROSS-REFERENCE TO RELATED APPLICATION

This application is a continuation-in-part of U.S. patent application Ser. No. 14/765,330 (filed on Aug. 1, 2015), which issued as U.S. Pat. No. 9,644,408. U.S. patent application Ser. No. 14/765,330 is a national phase application of PCT/US2014/014340. PCT/US2014/014340 claims the benefit of priority to U.S. provisional patent application Ser. No. 61/759,951 (filed on Feb. 1, 2013). As such, this continuation-in-part application claims the benefit of priority to Ser. No. 14/765,330, PCT/US2014/014340, and 61/759,951.

FIELD OF THE INVENTION

The present invention relates to devices and methods of inhibiting the opening of a door. Such devices and methods may be used to barricade a door, and thereby prevent an intruder from entering a sheltering space, such as a classroom, storeroom, or hallway.

BACKGROUND OF THE INVENTION

In the prior art, there are devices for barricading a door. U.S. Pat. No. 6,481,252 (Calle et al.) discloses one such device. In Calle et al.'s patent, a cross bar pivots from a hinge assembly that is mounted to a door frame. To barricade the door, the cross bar pivots down to engage a locking brace that is attached to another part of the door frame.

Another prior art device is described in German Pat. No. DE202006008723U1 (Hogl). In Hogl's device, a locking rod ("sperrstange 14") must be manually (a) lifted from the floor using a knob ("knauf 15"), (b) the rod must be rotated until the rod is aligned with a bracket, and (c) axially moved until the rod engages with the locking member ("sperrglied 6"). Successfully accomplishing these operations with one hand would be difficult, and for some people would be impossible—so, two hands are likely necessary to lift, rotate and axially move the rod in order to achieve barricading of the door. Furthermore, Hogl's device requires the user to stand while barricading the door.

These devices and others in the prior art are difficult to use, especially for children, a person in a wheelchair, or a person that is crouching or lying on the floor. In a situation in which an intruder has entered a building, the prior art devices would likely prove inadequate because operating them is complicated and may be unsafe, thereby increasing the likelihood that a door will not be barricaded in time to prevent an intruder from entering the room.

SUMMARY OF THE INVENTION

Door barricades and methods of barricading a door are disclosed herein. For example, a door barricade may have a pivotable stop-device, which has a barricade arm. The barricade arm may include a metal bar and/or a plastic extension. The barricade arm may be pivotable about a pivot axis. The pivot axis may be:

(a) nearer to an edge of the door where a latching mechanism of the door is located than to an edge of the door where door hinges are located, and (b) at an elevation lower than an elevation of a door handle on the door.

For example, the pivot axis may be located adjacent to the door, for example to coincide with a frame of the door or a wall adjacent to the frame.

The barricade arm may be pivotable about the pivot axis from a reserve-position to a barricade position. In the reserve-position, the barricade arm does not barricade the door and a distal-end of the barricade arm is at a first elevation. In the barricade-position the barricade arm does barricade the door and the distal-end is at a second elevation. The elevations are measured from a floor adjacent to the door, the first elevation is less than the second elevation. When the stop-device and its barricade arm are in the barricade-position, the barricade arm does not span the width of the door.

The door barricade may include a bracket that is positioned to overlap the barricade arm when the barricade arm is in the barricade-position, but not when the barricade arm is in the reserve-position. The bracket may be oriented to receive and overlap the barricade arm as the barricade arm moves away from a floor adjacent to the door. In this manner, the barricade arm need only rotate in order to achieve the barricade position and also be within the bracket once the barricade position is achieved. The bracket may be mounted to a wall adjacent to the door, or to the door itself, or to a door frame that is associated with the door. Multiple brackets may be used and they may be mounted to one or more of a wall adjacent to the door, and/or to the door itself, and/or to a door frame that is associated with the door.

The barricade arm may have two ends. One end is located proximate to the pivot axis (the "proximate end") and the other end is located distally from the pivot axis (the "distal end"). In some embodiments of the invention, the distal end is not engaged with anything when the stop-device, and in particular the barricade arm, is in the barricade position.

When some embodiments of the invention are in use, the distal-end of the barricade arm moves away from a floor adjacent to the door when the stop-device moves from the reserve-position toward the barricade-position. Such embodiments may be particularly well suited to be operated by a person who is lying on the floor, crouching next to the door, or sitting in a wheel chair.

Some embodiments of the invention are configured so that not more than three pounds of force applied to the distal-end of the barricade arm is required in order to move the stop-device, and in particular the barricade arm, to the barricade-position. A spring of motor may be employed for this purpose. For example, a person desiring to deploy the stop-device, and in particular the barricade arm, to the barricade position may manually (e.g. by hand or by foot) apply a force not exceeding three pounds to the distal end of the barricade arm in order to move the distal end of the arm (and the stope-device) to a predetermined position, at which point the spring or motor may be activated to assist (partially or entirely) with moving the stop-device, and in particular the barricade arm, to the barricade position. The motor may be powered by electricity. Such electricity may be provided by a battery, or by a power generating facility (e.g. a local electric utility company) having an electric generator.

When the door barricade includes a motor and/or spring for moving the stop-device, and in particular the barricade arm, the stop-device may include a linkage system so that forces supplied by the motor and/or spring are transferred in a manner that results in the barricade arm pivoting about the pivot axis. The linkage system may include a means for transferring force from the motor or spring to the barricade arm, such as one or more chains and/or a gears.

Such a linkage system may selectively connect the motor and/or spring with the stop-device so that the barricade arm can be moved manually and without the assistance of the spring and/or motor. Toward that end, the linkage system may include a disengaging mechanism that disengages the motor and/or spring from the stop-device when the motor lacks the ability to move the barricade arm, and thereby permits moving the stop-device, and in particular the barricade arm, without moving the motor and/or spring.

Many embodiments of the invention may be configured so that not more than three pounds of force needs to be applied to the distal-end of the barricade arm in order to move the barricade arm to a position in which the motor or spring will then move the barricade arm to the barricade-position.

As mentioned above, the stop-device, and in particular the barricade arm, may be pivotable to rotate about an axis. The axis may be oriented and positioned so that the stop-device, and in particular the barricade arm, is positioned to rotate about an axis, which, if extended, would traverse a wall adjacent to the door. For example, the axis may be oriented to be substantially perpendicular to a wall adjacent to the door.

Some embodiments of the invention may include a fire extinguisher. To facilitate the inclusion of a fire extinguisher, the door barricade may have a means for holding the fire extinguisher. That means for holding may be a ledge on which the fire extinguisher is supported. Such a ledge may be part of a cover that conceals from view all or part of the stop-device.

The door barricade may include an alarm or may be connected to an alarm system that is triggered by a predetermined set of circumstances. The alarm or alarm system may include an audible notification and/or a visual notification in order to warn people of a particular type of situation. For example, the alarm may be triggered when (a) the stop-device, and in particular the barricade arm, begins to move toward the barricade position, and/or (b) when the stop-device, and in particular the barricade arm, reaches the barricade position, and/or (c) when a fire extinguisher is removed from the door barricade. In the case of an alarm that is triggered by the removal of the fire extinguisher, a switch may be provided for detecting the presence of the fire extinguisher. When the presence of the fire extinguisher is not detected, an alarm may be sounded and/or the fire department may be summoned.

A release/override mechanism may be provided so that the stop-device, and in particular the barricade arm, can be moved from the barricade-position to the reserve-position. Such a release/override mechanism may be operable by an authorized person (e.g. fire-fighter, police officer, school administrator) who is prevented from opening the door when the stop-device, and in particular the barricade arm, is in the barricade-position. In some embodiments of the invention, the release/override mechanism merely allows the stop-device to be moved to the reserve position, while other embodiments of the release/override mechanism actually move the stop-device (e.g. by a motor or spring), and in particular the barricade arm, to the reserve position. The release/override mechanism enables an authorized person to move the stop-device to the reserve position, and then open the door in order to enter the room that was previously barricaded.

The barricade-device may include a shield that prevents access to the barricade arm by an intruder when the stop-device is in the barricade-position. Such a shield may be mounted to the door that is being barricaded, and positioned between the barricade arm and a window on the door so that if the intruder breaks the window and reaches toward the barricade arm, the shield prevents the intruder from touching the barricade arm. Such a shield may be used to prevent the intruder from damaging the barricade arm, or moving the barricade arm as part of an attempt to gain access to the room associated with the door.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
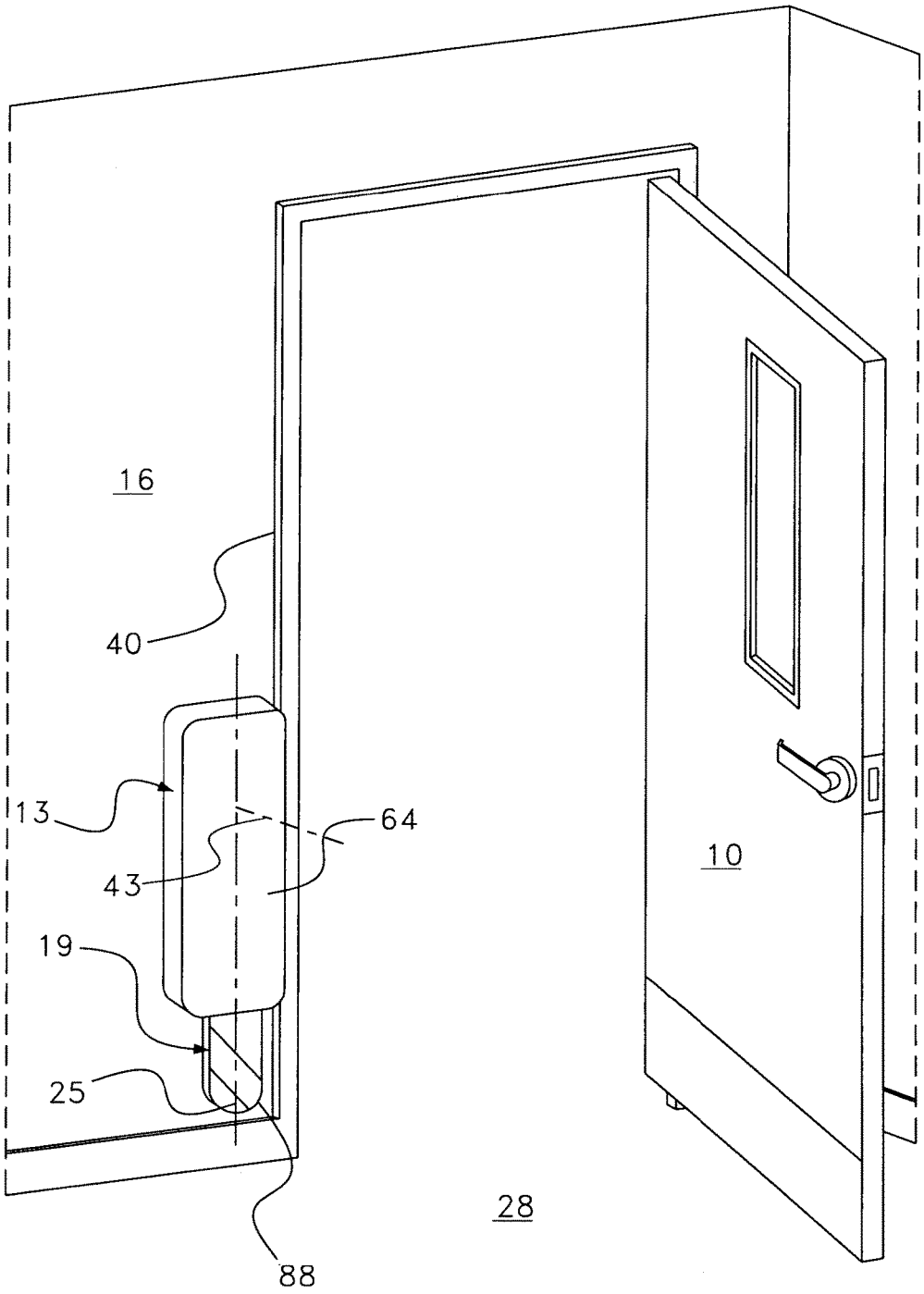
FIG. 1 depicts a classroom having a barricade-device mounted to a wall adjacent to a door.

Disclosed herein are barricade-devices that may be used to barricade a door, and thereby prevent an intruder from entering a safe sheltering space, such as a classroom or hallway. Initially, a general description of features that may be included in a door barricade is provided. Then, with reference to the figures, a more detailed description of some specific embodiments of the invention is provided.

The barricade-device may have a pivotable stop-device that is pivotable from a location adjacent to a door. The pivot-location is at an elevation that is lower than a door handle on the door. The stop-device is pivotable from a reserve-position to a barricade-position. In the reserve-position, the stop-device does not barricade the door. In the barricade-position, the stop-device barricades the door.

The barricade-device may include a bracket that is positioned to overlap an arm of the stop-device when the stop-device is in the barricade-position. But when the stop-device is in the reserve-position, the bracket does not overlap the stop-device. The bracket may be oriented to receive the stop-device as the stop-device moves away from a floor adjacent to the door and into the barricade-position.

The barricade-device may include one or more brackets for overlapping the arm when the stop-device is in the barricade-position. Such brackets may be mounted to the door, but other locations are possible. For example, brackets may be mounted to the door frame that is located between the door and the axis about which the stop-device rotates, and/or to the wall between the door frame and the axis about which the stop-device rotates.

Also disclosed herein is a method of barricading a door. Such a method may include providing a pivotable stop-device that is positioned to pivot from a pivot-location. The pivot-location may be adjacent to the door at an elevation that is lower than a door handle, which is on the door and used to unlatch the door. Such a method includes pivoting the stop-device about the pivot-location from the reserve-position to the barricade-position. The method may include providing a bracket that is positioned to overlap an arm of the stop-device when the stop-device is in the barricade-position, but not when the stop-device is in the reserve-position. In such a method, the step of pivoting the stop-device may include the bracket receiving the stop-device as the stop-device moves away from a floor adjacent to the door and into the barricade-position.

In a specific embodiment of the invention a barricade-device for a door is arranged to prevent intruders from entering a room. That barricade-device may have a movable stop-device and a spring that is mechanically linked to the stop-device so as to bias the stop-device to a barricade-position, in which an arm of the stop-device prevents a door from opening. The stop-device may include a pivotable cam and an arm extending from the cam. A distal-end of the arm moves away from a floor adjacent to the door when the stop-device moves toward the barricade-position. In one embodiment of the barricade-device, not more than three pounds of force (applied to the distal-end of the arm) is required to move the stop-device to a position in which the spring will then move the stop-device to the barricade-position. Such a force may be applied by hand or by foot.

To assist with moving the stop-device, a motor may be employed to provide a force that moves the stop-device to the barricade-position, or to a reserve-position, or both. The motor may be included along with the spring, or in lieu of the spring mentioned above. A linkage system may selectively connect the motor with the stop-device in order to transfer a force from the motor to the stop-device. A chain and/or gears (which may include sprockets) may be used in the linkage system. A disengaging mechanism may be included as part of the linkage system in order to disengage the motor from the stop-device when the motor lacks the ability to move the stop-device, and thereby permits moving the stop-device manually, for example, if electricity is not available to the motor due to an interruption of electric power.

When the motor is included, the motor may be activated by application of a force to the distal-end of the arm. Such a force may be applied by hand or by foot. When the force applied to the distal-end of the arm moves the stop-device by a predetermined amount, the motor turns on to bring the stop-device to the desired position (either the barricade-position or the reserve-position, depending on the direction in which the force is applied to the distal-end of the arm).

The barricade-device may be attached to a wall adjacent to the door at an elevation that places the cam lower than an elevation of a door-handle of the door. In doing so, the barricade-device may be made readily usable by many people, including children, those in wheel chairs, and those lying, crouching or kneeling on the floor.

A release/override mechanism may be provided that may be used to move the stop-device from the barricade-position to the reserve-position. It is anticipated that the release/override mechanism may be operated by an authorized person who is otherwise prevented from opening the door when the stop-device is in the barricade-position.

Having provided a general overview of features that may be included in a door barricade, a more detailed description of some embodiments is provided below.

Figure 2:
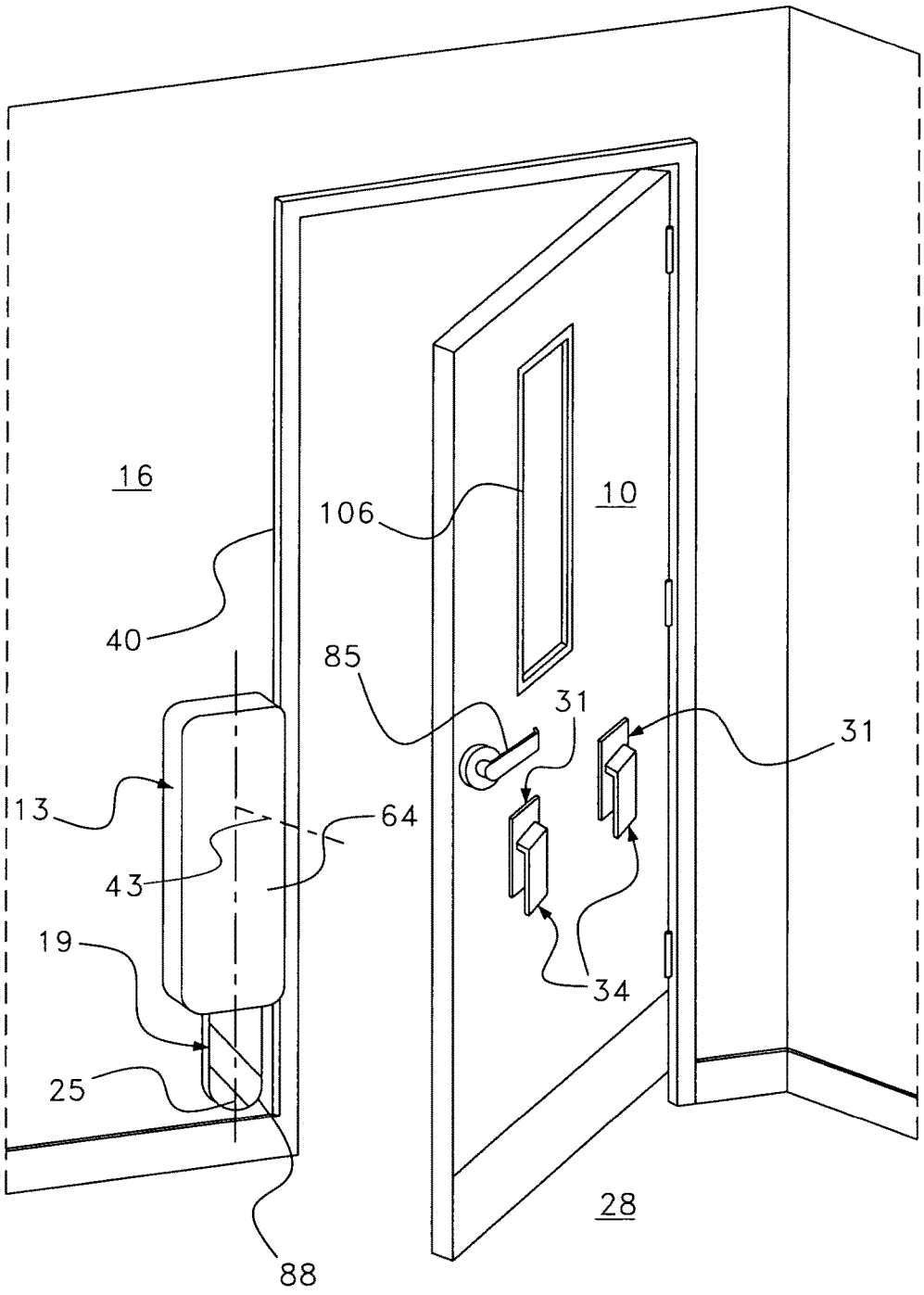
FIG. 2 depicts the classroom of FIG. 1 with the door partially closed.
Figure 3:
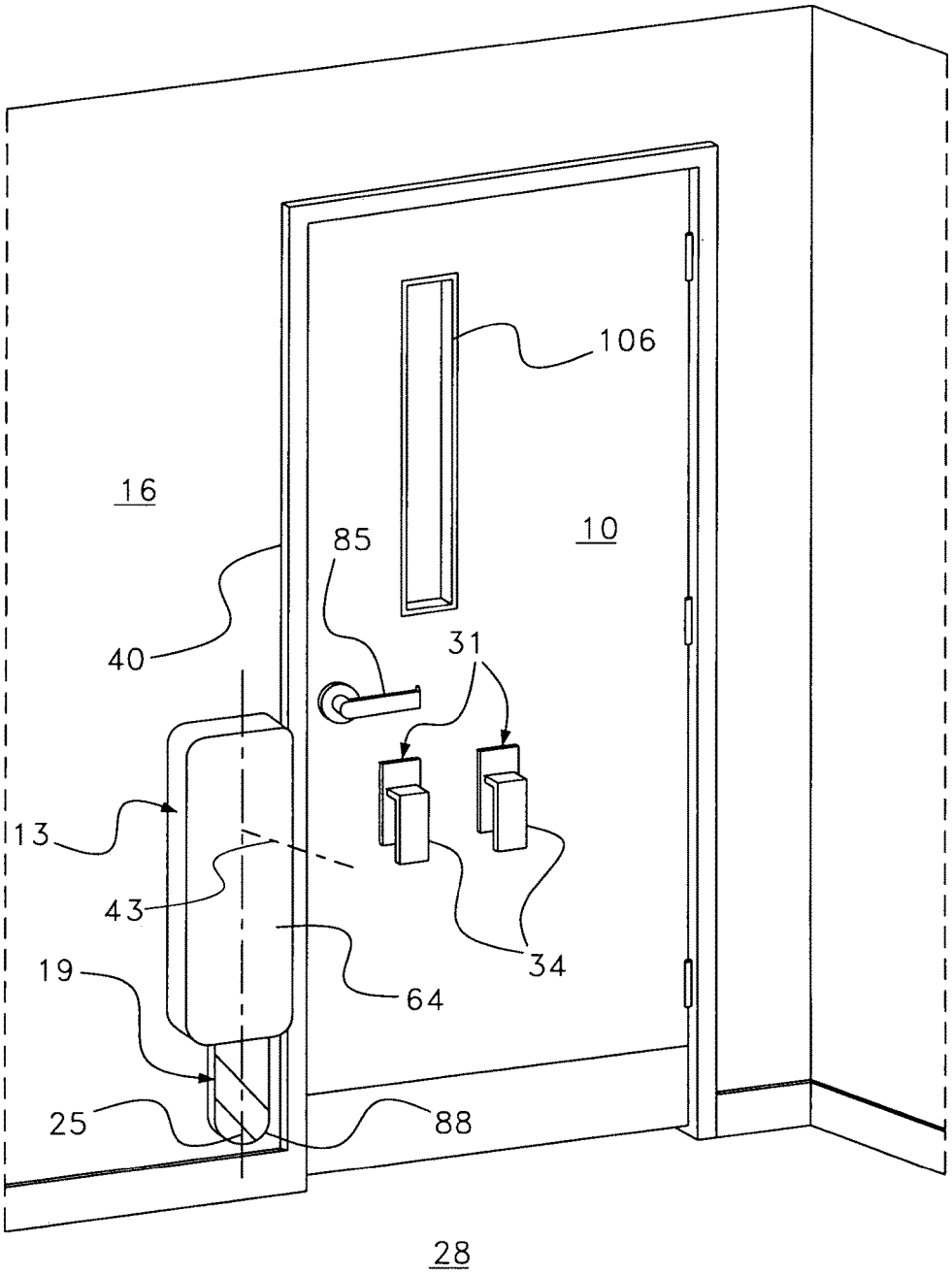
FIG. 3 depicts the classroom of FIG. 1 with the door closed.

FIGS. 1-5 depict a classroom door 10 and a barricade-device 13 at various stages. FIG. 1 shows the classroom door 10 open and the barricade-device 13 mounted to a wall 16 adjacent to the door 10. FIG. 2 shows the door 10 in a partially closed position, and FIG. 3 shows the door 10 in the closed position. In FIGS. 1-3, the barricade-device 13 does not prevent the door 10 from opening or closing, and thus these three figures illustrate how the barricade-device 13 might look when there is no need to prevent an intruder from entering the classroom. In this position, an arm 19 of the barricade-device 13 is held in reserve, and is therefore said to be in the "reserve-position". The arm 19 is part of a stop device 22, which is explained more fully below in conjunction with FIGS. 8 and 10 (among others). In FIG. 1, the reserve-position is fully achieved when a longitudinal axis 25 of the arm 19 is substantially vertical relative to the floor 28 adjacent to the door 10. Herein, the floor 28 is assumed to be (for descriptive purposes) a substantially horizontal reference plane.

Figure 4:
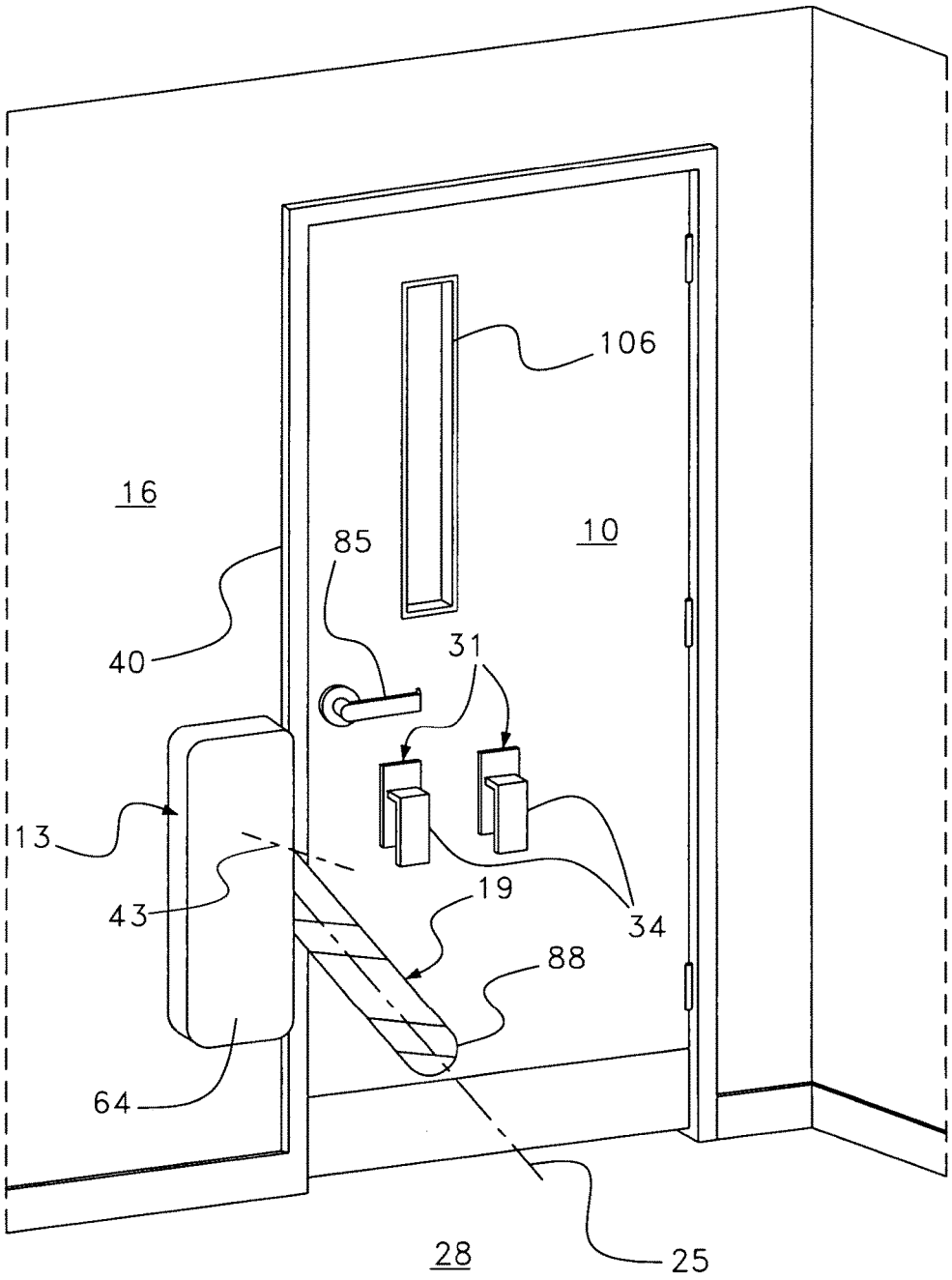
FIG. 4 depicts the classroom of FIG. 3 with an arm of the barricade device partially deployed toward the barricade-position.
Figure 5:
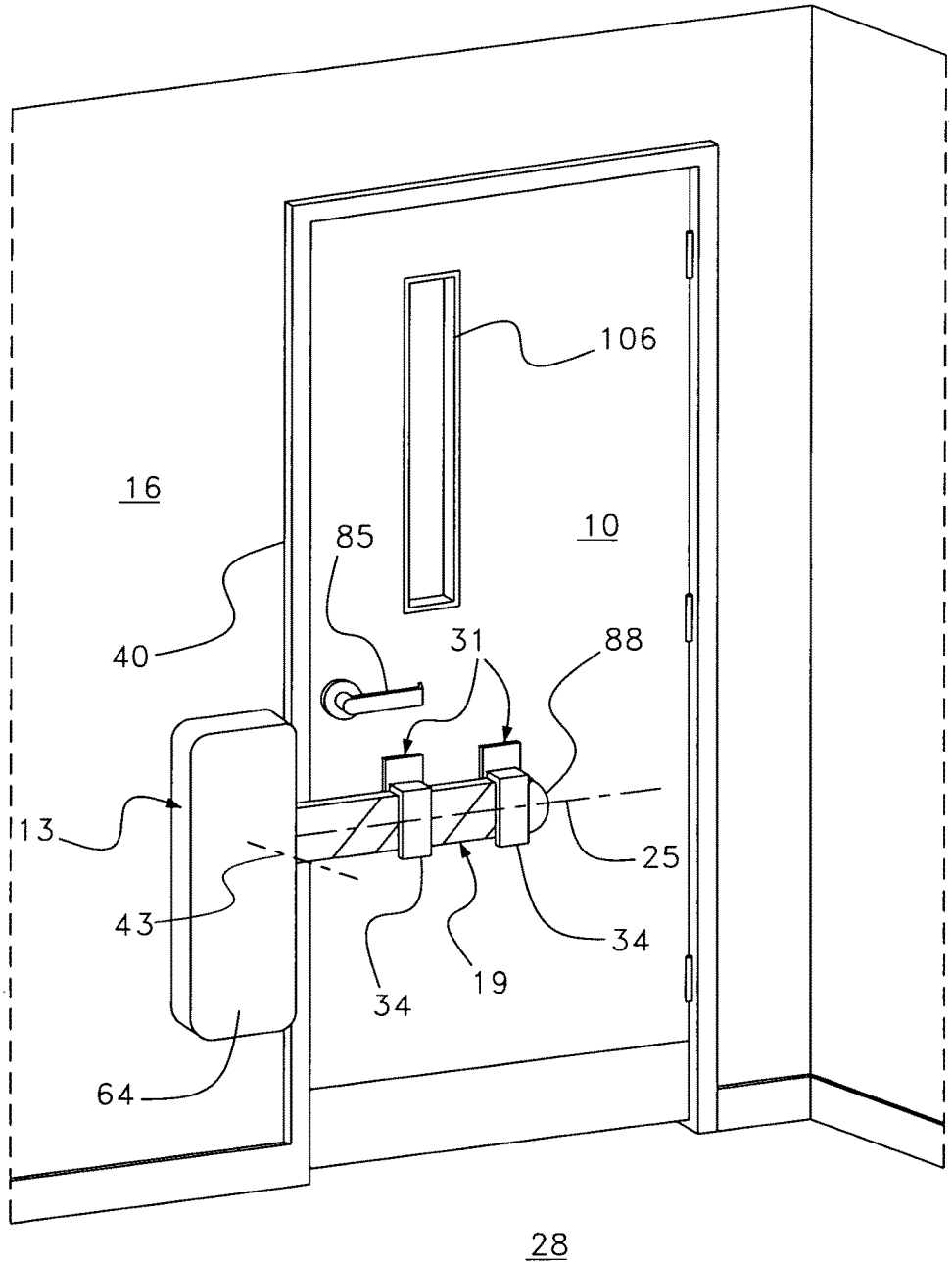
FIG. 5 depicts the class room of FIG. 3 with the arm of the barricade-device in the barricade-position.

FIG. 4 shows the arm that is moving from its reserve-position toward a barricade-position, which is shown in FIG. 5. In the barricade-position, the arm 19 inhibits or prevents the door 10 from being opened. In FIG. 5, the barricade-position is fully achieved when the longitudinal axis 25 of the arm 19 is substantially horizontal. That is to say that in FIG. 5, the barricade-position is fully achieved when the longitudinal axis 25 of the arm 19 is substantially parallel with the reference plane—here, the floor 28. It should be noted that in some embodiments of the barricade-device 13, the barricade-position may be achieved when the longitudinal axis 25 is not substantially parallel with the floor 28. Also, it should be noted that a distal-end 88 of the arm 19 moves away from the floor 28, which is adjacent to the door 10, when the stop-device 22 moves from the reserve-position toward the barricade-position.

FIGS. 4 and 5 show a pair of brackets 31 that have been mounted to the door 10. The brackets 31 are designed and mounted to overlap the arm 19 when the stop-device 22 is in the barricade-position, but not when the stop-device 22 is in the reserve-position. The brackets 31 overlap the arm 19 so that the arm 19 resides between an outer-portion 34 of the bracket 31 and the door 10 when the stop-device 22 is in the barricade-position. When the stop-device 22 is not in the barricade-position, for example when the stop-device 22 is in the reserve-position, the arm 19 is not overlapped by the brackets 31. Some embodiments of the barricade-device 13 include a bracket 31 that is not mounted to the door 10, and/or the frame 40, and/or the wall 16, and other embodiments do not have any brackets for overlapping the arm 19.

Unlike many prior art devices, the arrangement shown in FIG. 5 does not require the arm 19 to span the entire width of the door 10. By providing brackets (e.g. to the door 10) and providing a wall-anchored body assembly, the fulcrum points are shortened and the assembly strengthened, thereby making a door barricade that does not require a bar to span the entire width of the door 10. The stop-device 22 pivots from a location that is near an edge of the door 10 where the door handle 85 and associated latching mechanism is located, rather than being positioned closer to the hinged-edge of the door 10. By making and locating the stop-device 22 in a manner that does not require the arm 19 to span the width of the door 10 in order to achieve barricading of the door 10, the barricade-device 13 can be mounted nearer the floor 28, and also the barricade-device 13 may be operated so that the arm 19 moves upward (away from the floor 28) from the reserve-position to the barricade-position. This mode of operation allows a shorter person such as a child, a wheelchair-bound person or someone in a crouched or kneeling position to deploy the arm 19 to the barricade-position. In addition, by not requiring the arm 19 to span the width of the door 10, the arm 19 can be moved to the barricade-position faster than the prior art barricades.

The barricade-device 13 may be equipped with an alarm, which is activated when the stop-device 22 moves from the reserve-position toward the barricade-position and/or when the stop-device 22 achieves the barricade-position. The alarm may provide an audible notification, visual notification, or both. In this manner, it will be possible to know when and where doors have been barricaded. An audible alarm may be provided as a siren or buzzer. A visual alarm may be provided as a light, which may flash.

Figure 7:
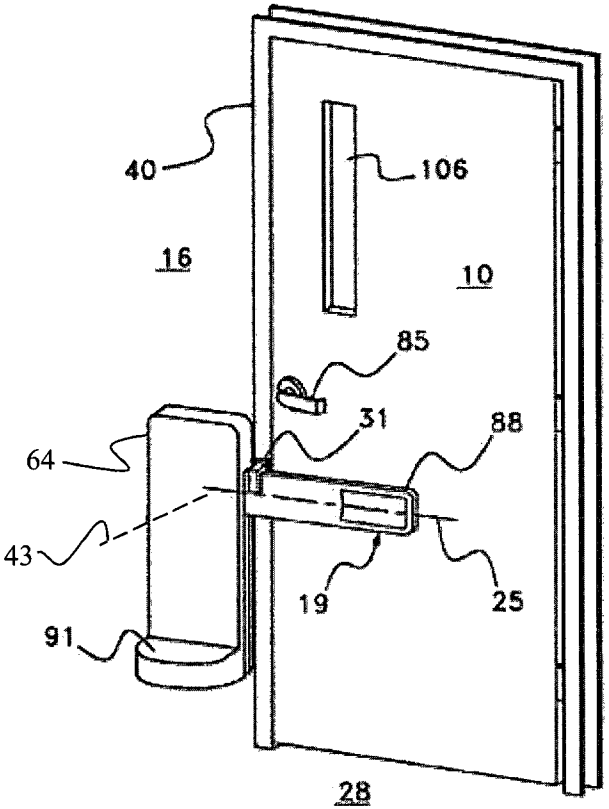
FIG. 7 depicts the arrangement of FIG. 6 with the arm in the barricade-position.
Figure 6:
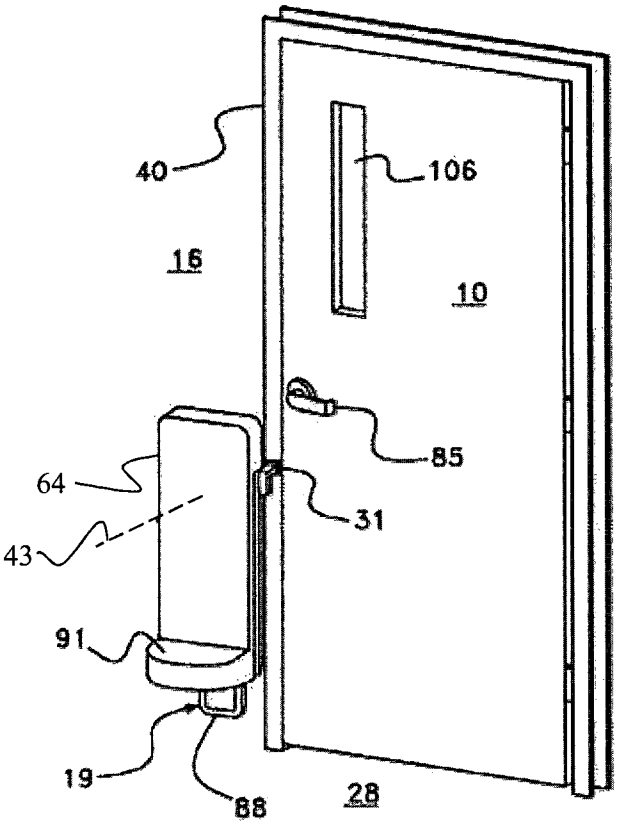
FIG. 6 depicts another arrangement of a barricade-device with the arm in a reserve-position.

FIGS. 6 and 7 show a different embodiment of the barricade-device 13 in which a bracket 31 is mounted at a location between a cam 37 (see FIGS. 8 and 10) and the door 10. In this particular arrangement, the bracket 31 is mounted to the door frame 40. In this arrangement, the bracket 31 is mounted at a location between the door 10 and an axis 43 about which the stop-device 22 rotates between the reserve-position and the barricade-position. Like the embodiment shown in FIGS. 1-5, the arm 19 does not extend across the entire width of the door 10. Also like the embodiment shown in FIGS. 1-5, the stop-device 22 pivots from a location that is near an edge of the door 10 where the door handle 85 and associated latching mechanism is located, rather than being positioned closer to the hinged-edge of the door 10. Another option affixes a bracket 31 to the wall 16 at a location that is between that stop-device axis 43 and the door frame 40. For clarity, FIGS. 1-7 show a barricade-device 13 in which the stop-device 22 rotates about an axis 43, which (if extended) would traverse the wall 16 adjacent to the door 10. More specifically, FIGS. 1-7 show a barricade-device in which the stop-device 22 rotates about an axis 43 that is substantially perpendicular to the wall 16 that is adjacent to the door 10.

Figure 8:
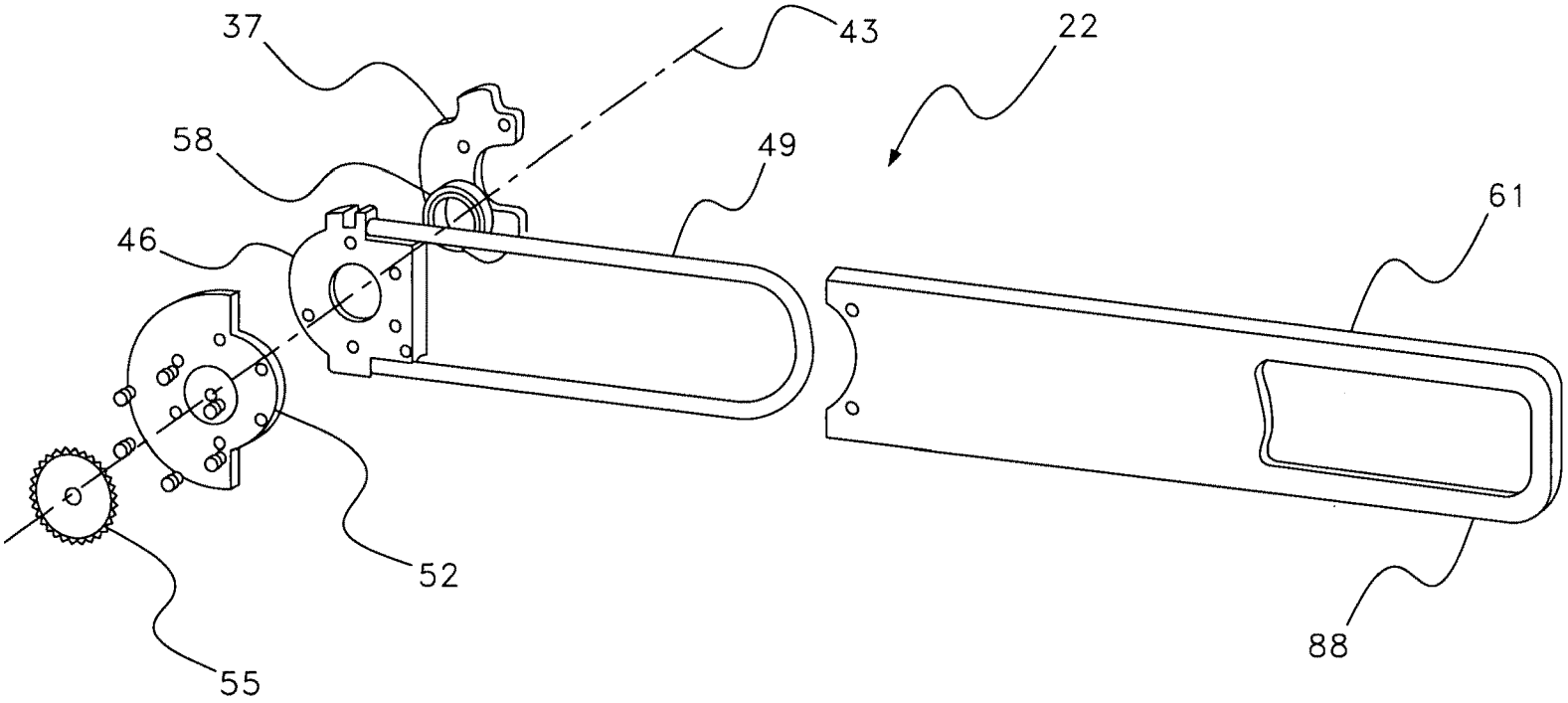
FIG. 8 depicts features of a stop-device.

FIG. 8 shows details of a stop-device 22 that may be used. That stop-device 22 includes a connective base 46, a bar 49 that is connected to the base 46, a motion control cam 37 that is connected to the base 46, a spring-anchor 52 that is connected to the base 46, a sprocket 55 that is connected to the anchor 52, and a bearing 58. The bar 49 may be covered by a plastic extension 61 in order to make the stop-device 22 more aesthetically pleasing, and in order to extend the distal-end of the stop-device 22 so that less force is required. (by virtue of the longer moment arm) to manually move the stop-device 22 between the reserve-position and the barricade-position. In the arrangement depicted in FIG. 8, the bar 49 and extension 61 comprise what was previously referred to as the arm 19.

Figure 9:
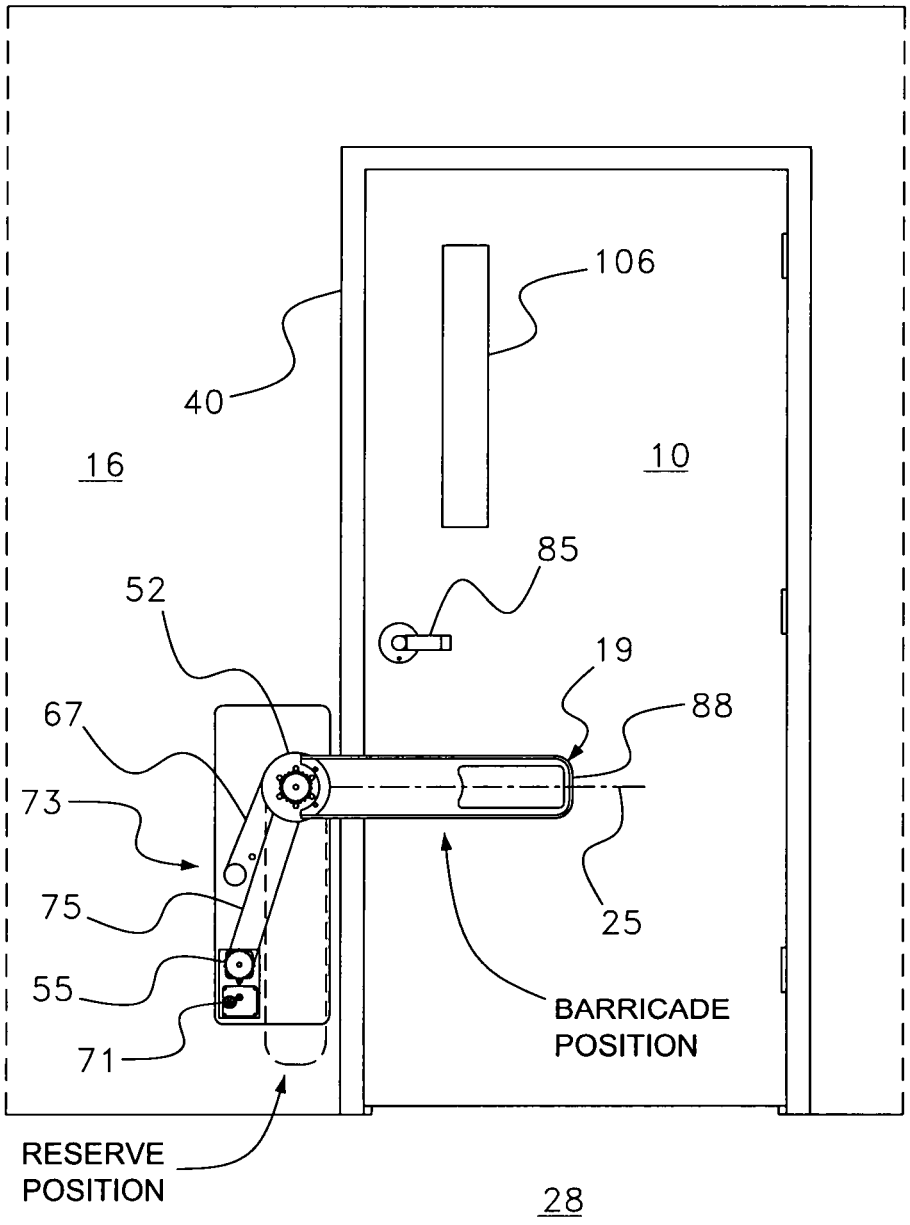
FIG. 9 depicts the arrangement of FIG. 7 with a protective cover removed to show certain features of the barricade-device.

FIG. 9 shows yet another embodiment of the barricade-device 13, in which there is no bracket. Although the barricade-device 13 may be configured without a bracket, it is currently believed that having one or more brackets 31 may make the barricade-device 13 better able to prevent opening of the door 10 by an intruder.

Figure 10:
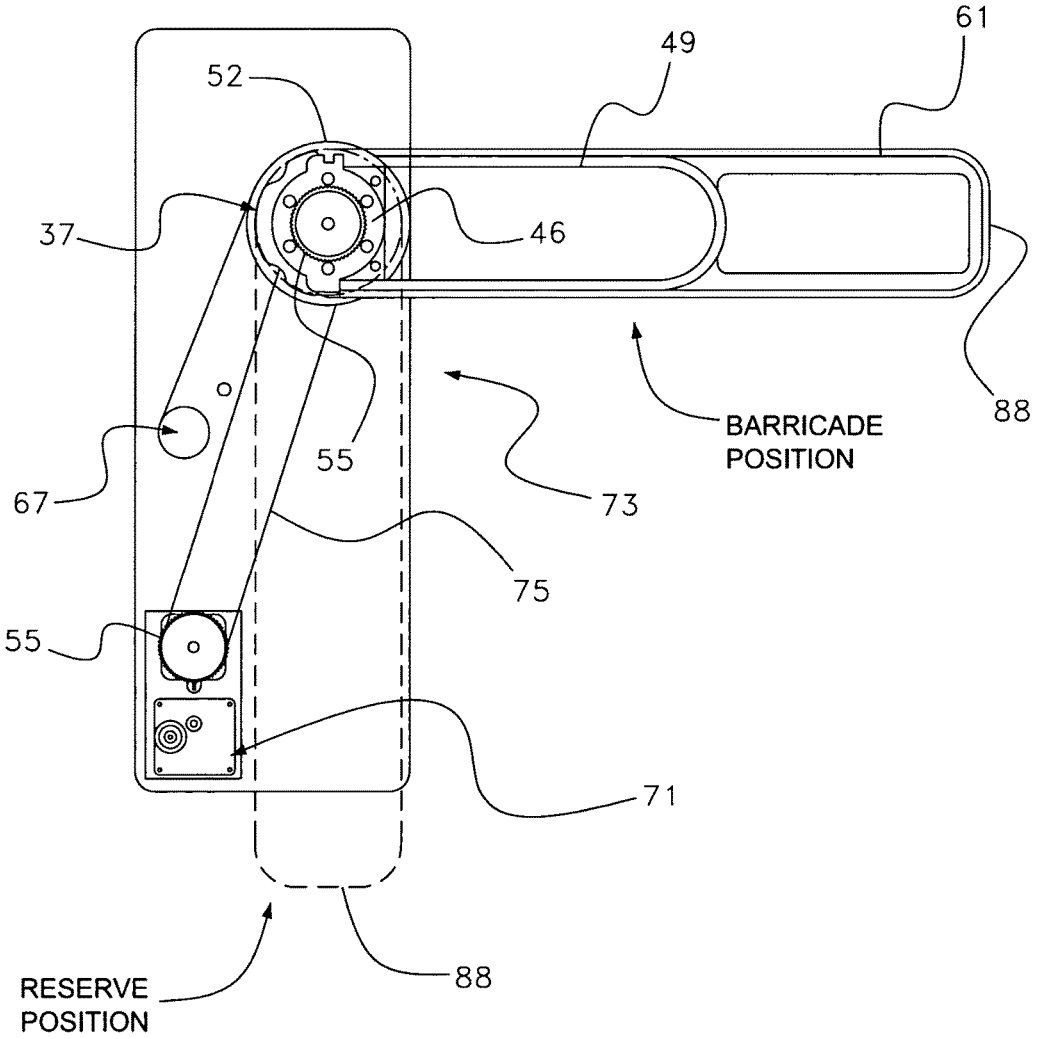
FIG. 10 is an enlarged view of the barricade-device depicted in FIG. 9, with the plastic extension shown in phantom to reveal aspects of the movable stop device.
Figure 11:
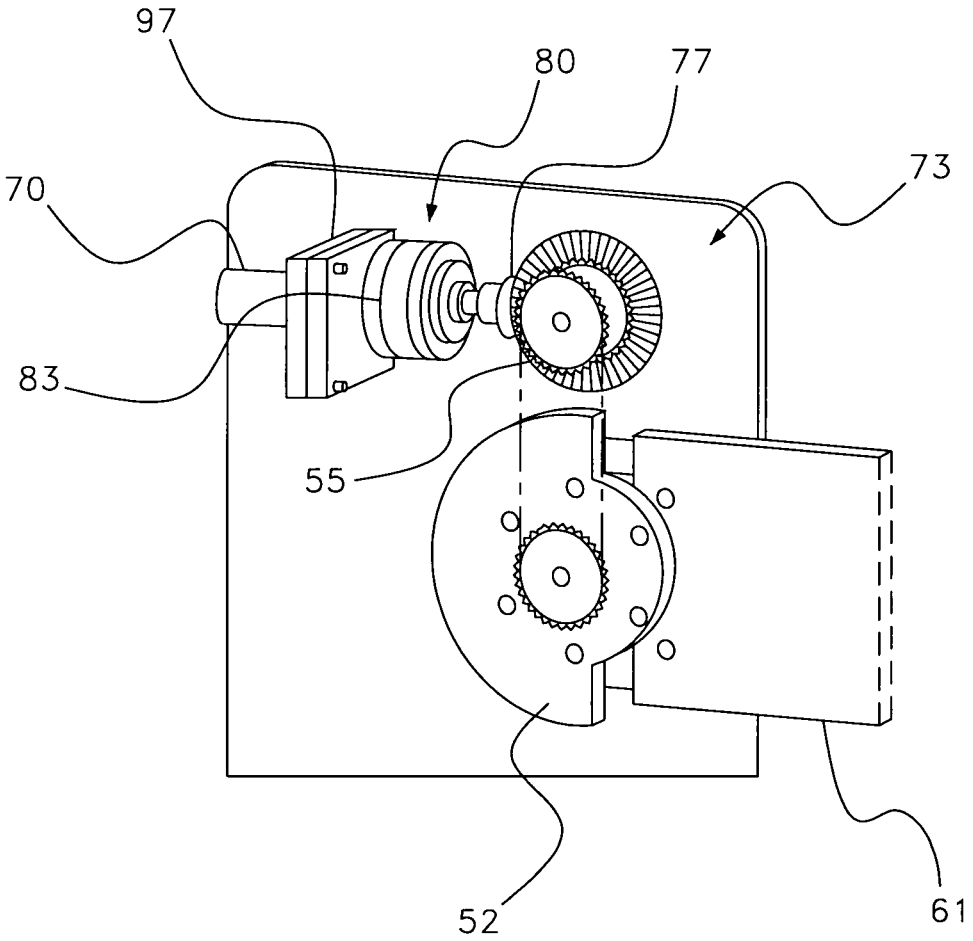
FIGS. 11 and 12 depict an arrangement of the barricade-device having a motor and linkage system.
Figure 12:
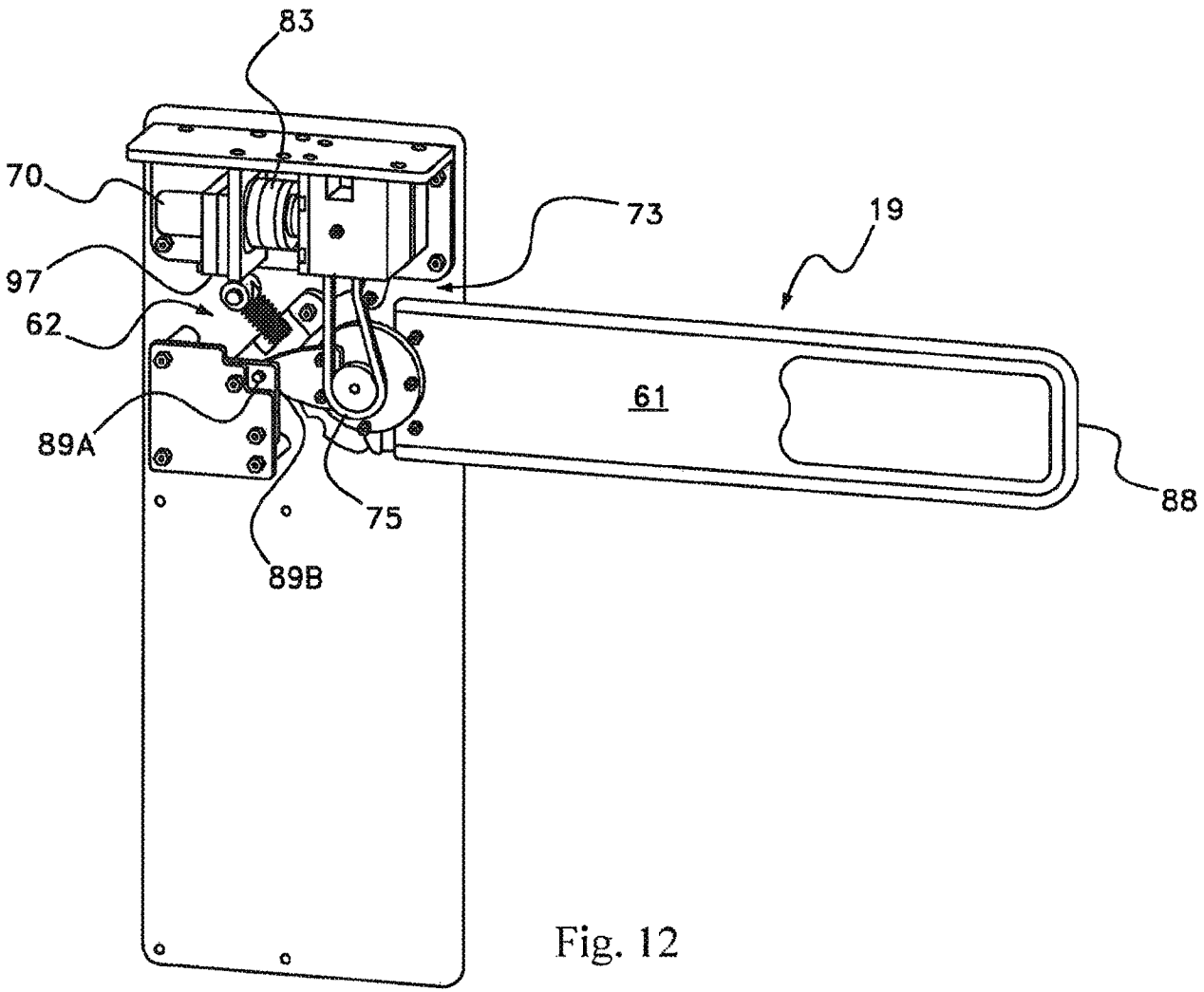
Figure 13:
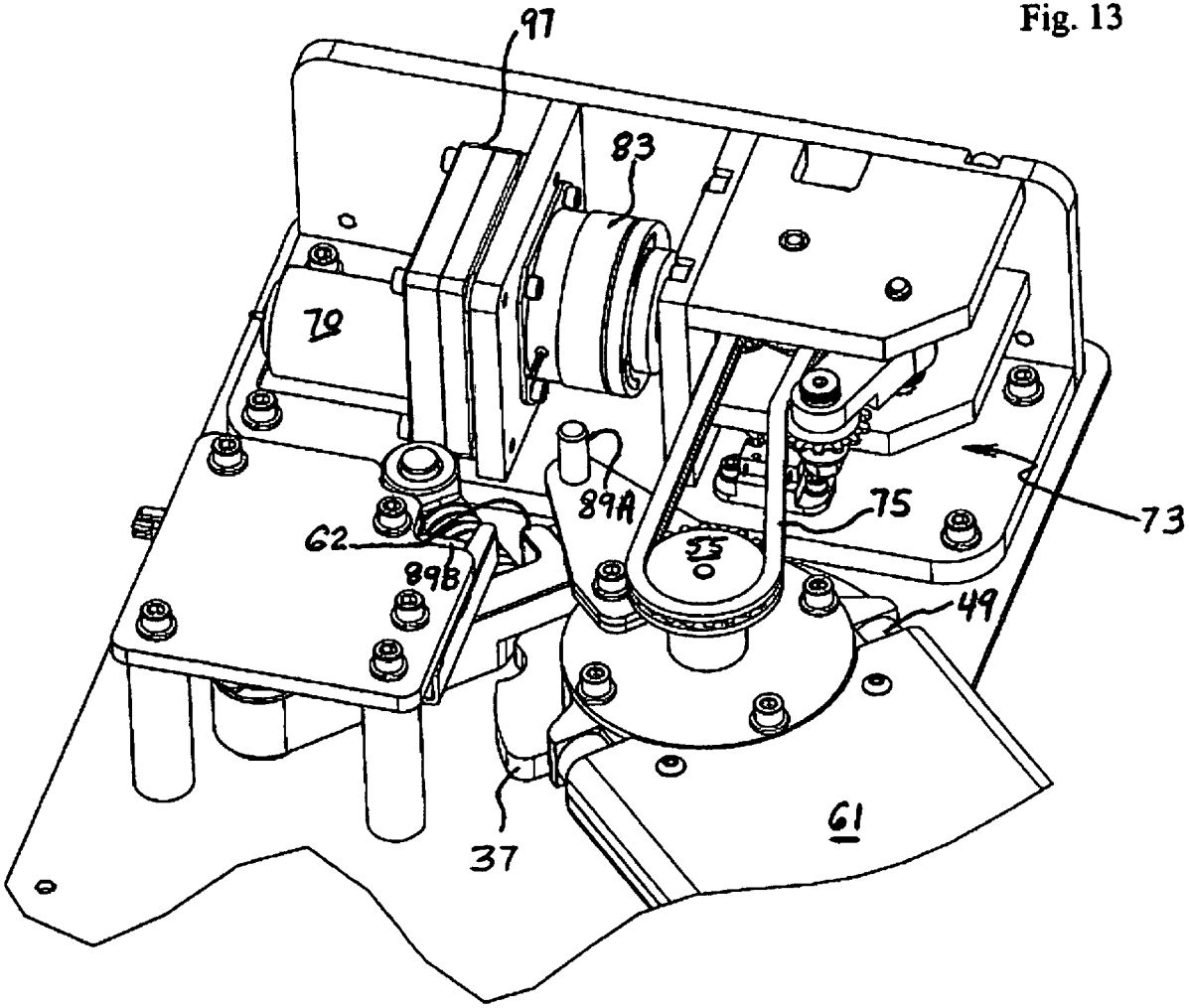
FIG. 13 depicts another arrangement having a motor and linkage system.

Unlike FIGS. 1-7, FIGS. 1 and 10 depict the barricade-device 13 without the protective cover 64 so that additional details may be more easily described. FIG. 10 is an enlarged view of the barricade-device 13 that is depicted in FIG. 9. FIGS. 9 and 10, illustrate that the stop-device 22 may be comprised of an arm 19 that is attached to a cam 37. Although the cam 37 and the bar 49 are depicted as two pieces, the arm 19 and the cam 37 may be provided as a unitary piece.

The barricade-device 13 may include a spring 67, which is mechanically linked to the stop-device 22. For example, the spring 67 may be mechanically linked to the anchor 52. The spring 67 biases the stop-device 22 to the barricade-position (see, for example, FIGS. 5, 7 and 9), in which the arm 19 prevents a door 10 from opening. The cam 37 is part of a motion control system that includes a cam follower 62. The shape of the cam 37 may be made so that the force of the spring 67 is not enough to move the stop-device 22 to the barricade-position until the stop-device 22 is rotated a desired amount (e.g. 5 degrees of rotation about the axis 43). Upon being rotated the desired amount (e.g. by a force applied by hand or by foot to the distal-end 88 of the arm 19), a resistance-force provided by the cam follower 62 will be reduced by virtue of the shape of the cam 37, and with the resistance-force reduced, the force provided by the spring 67 is sufficient to move the stop-device 22 to the barricade-position. It should be noted that, unlike many prior art devices, the force required to rotate the stop-device 22 about the axis 43 allows the use of major muscle groups of the body, and need not require precise dexterity of the fingers or hands (e.g. such as that required to manipulate small keys, latches, and/or the grasping and turning of assemblies). As such, with the prior art barricades in mind, it will be recognized that the barricade-device 13 may be used effectively for its designed purpose more quickly by a wider range of people having differing physical and mental capabilities.

Also shown in FIGS. 9 and 10 is a motor 70 that is capable of providing a force to move the stop-device 22. For example, the motor 70 may be powered by electricity, which may be provided by an electric utility via wires from the power-supply grid to the building, or by a battery 71, which may be concealed from view by the protective cover 64. The motor 70 may be configured to move the stop-device 22 from the reserve-position to the barricade-position, or from the barricade-position to the reserve-position. Alternatively, the motor 70 may be configured to move the stop-device 22 in either direction. A linkage system 73 may be provided to transfer force from the motor 70 to the stop-device 22. Toward that end, the linkage system 73 may include a chain 75 and/or one or more gears 77 (including the sprockets 55) in order to facilitate movement of the stop-device 22 by the motor 70 by transferring a force supplied by the motor 70 to the stop-device 22.

FIGS. 11-14 depict an arrangement of the linkage system 73 that includes a disengaging mechanism 80. The disengaging mechanism 80 allows for movement of the stop-device 22 when the motor 70 is not able to provide the force needed to move the stop-device 22. For example, when electric power cannot be provided to the motor 70, and the motor therefore lacks the ability to move the stop-device 22, the disengaging mechanism 80 may disconnect the motor 70 from the stop-device 22 so that the stop-device 22 can be moved without moving the motor 70. In lieu of moving the stop-device 22 with the motor 70, the stop-device 22 may be moved manually, or by the spring 67, or by a combination thereof. For example, the manual force may be applied to the arm 19, and/or the force of the spring 67 may be applied to the anchor 52.

In FIGS. 11-14, the disengaging mechanism 80 includes an electric clutch 83, which provides a gap when power to the electric clutch 83 is lost. Other disengaging mechanisms 80 may be used, including a solenoid. By providing a gap when power to the motor 70 is lost, the stop-device 22 may be more easily operated manually and/or by spring 67 because the motor 70 need not be turned in order to move the stop-device 22.

In FIGS. 1-7 and 9, the elevation of the stop-device axis 43 is lower than the elevation of the door-handle 85 (the elevations being measured from the floor 28 adjacent to the door 10). These FIGS. 1-7 and 9 also show the elevation of the arm 19 is lower than the elevation of the door handle 85. By placing the stop-device 22, and in particular the arm 19, below the handle 85, a child, a person in a wheelchair, or a person that is crouching or lying on the floor may more easily operate the stop-device 22 to either barricade the door 10, or not. Also, by placing the stop-device 22 near the floor 28, the arm 19 may be operated manually through the application of a force by hand or by foot. Furthermore, placing the stop-device 22 nearer to the floor 28 allows for purposeful and effective operation of the arm 19 by applying a force using major muscle groups, and does not require precise dexterity of the fingers or hands.

To facilitate use, the barricade-device 13 may be configured so that a force of not more than three pounds is required to manually move the stop-device 22 from the reserve-position to the barricade-position. For example, the barricade-device 13 may be configured through the shape of the cam 37 to require not more than three pounds of force applied to the distal-end 88 of the arm 19 in order to move the stop-device 22 to a position in which the spring 67 will then move the stop-device 22 to the barricade-position. By properly shaping the cam 37, more force (but preferably not more than three pounds) may be required to initially move the stop-device 22 through an initial arc of movement than is required to complete movement of the stop-device 22 to the barricade-position. In this manner, an inadvertent application of force to the arm 19 will not likely cause the stop-device 22 to move to the barricade-position, but the amount of force needed to deploy the stop-device 22 is not so great as to prevent most people from being able to deploy the stop-device 22 to the barricade-position.

In this manner, most people (including very young people, very old people, and many disabled people) will be able to operate the barricade-device 13. Furthermore, the barricade-device 13 may be configured so that a force of not more than three pounds is required to manually move the stop-device 22 from the barricade-position to the reserve-position. In this manner, children, a person in a wheelchair, or a person that is crouching or lying on the floor may deactivate the barricade-device 13 when needed, for example if a fire requires evacuation of the sheltered room or space, and thus the door may be un-barricaded quickly and easily so as to allow occupants to traverse the doorway quickly, easily, and without the need to possess precise dexterity of the fingers or hands. As such, the stop-device 22 may be placed in the reserve position quickly by a wide range of people having differing physical and mental capabilities.

The barricade-device 13 may be configured so that the motor 70 is activated when the distal-end 88 of the arm 19 is moved a predetermined distance (i.e. the stop-device 22 is rotated a desired angle) without the use of the motor 70. For example, activation of the motor 70 may be made when a strike pin 89A reaches a particular location. The motor may be turned off when the strike-pin 89A contacts a latch 89B. In this arrangement, the distal-end 88 of the arm 19 may be moved manually by a predetermined distance, and then the motor 70 will be activated to move the arm 19 into the barricade-position. It may be beneficial to allow movement of that predetermined distance (e.g. that resulting from a 5 degree rotation of the stop-device) by the application of not more than three pounds of force applied to the distal-end 88 of the arm 19.

Figure 14:
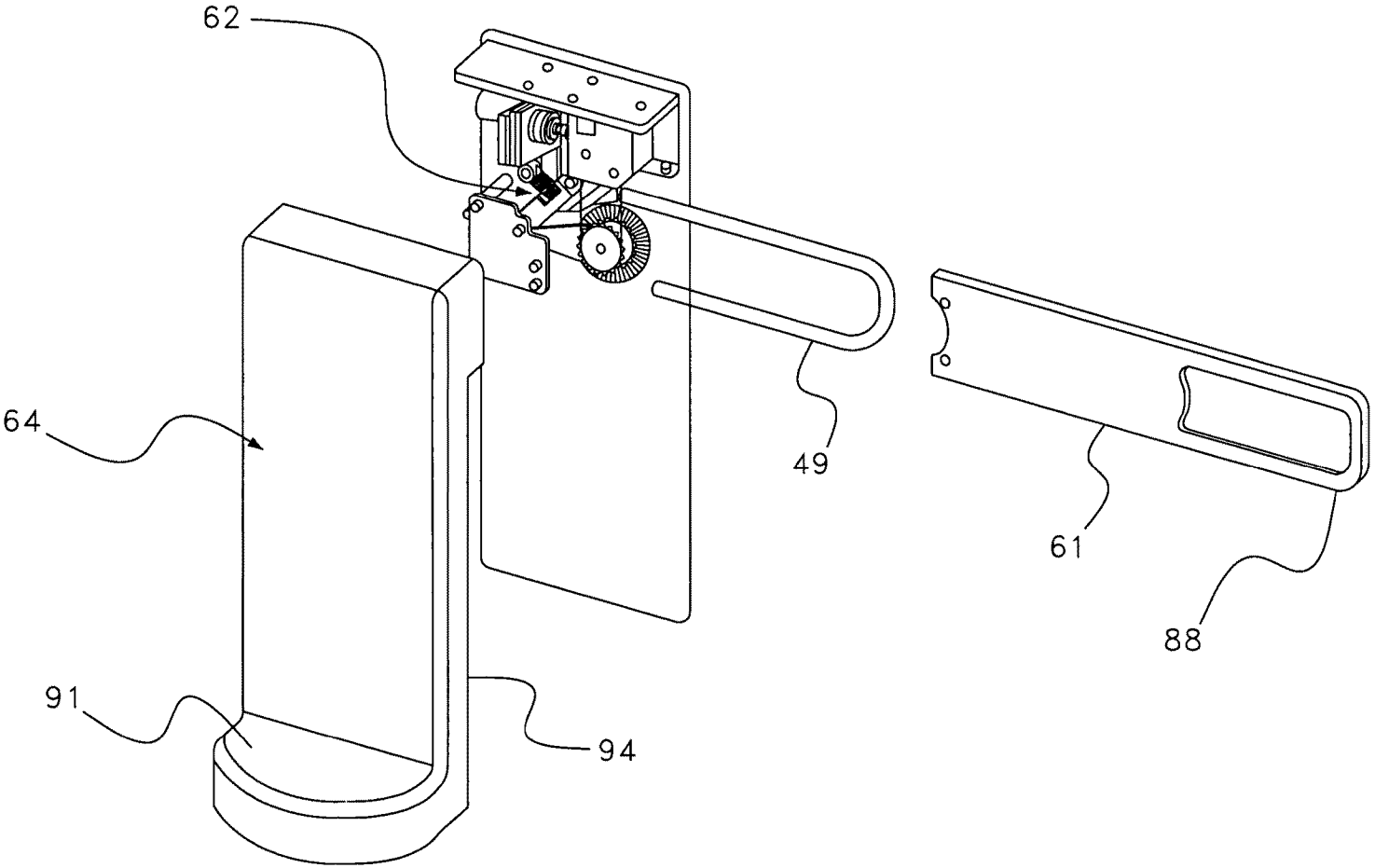
FIG. 14 is an exploded perspective view of a barricade-device.
Figure 15A:
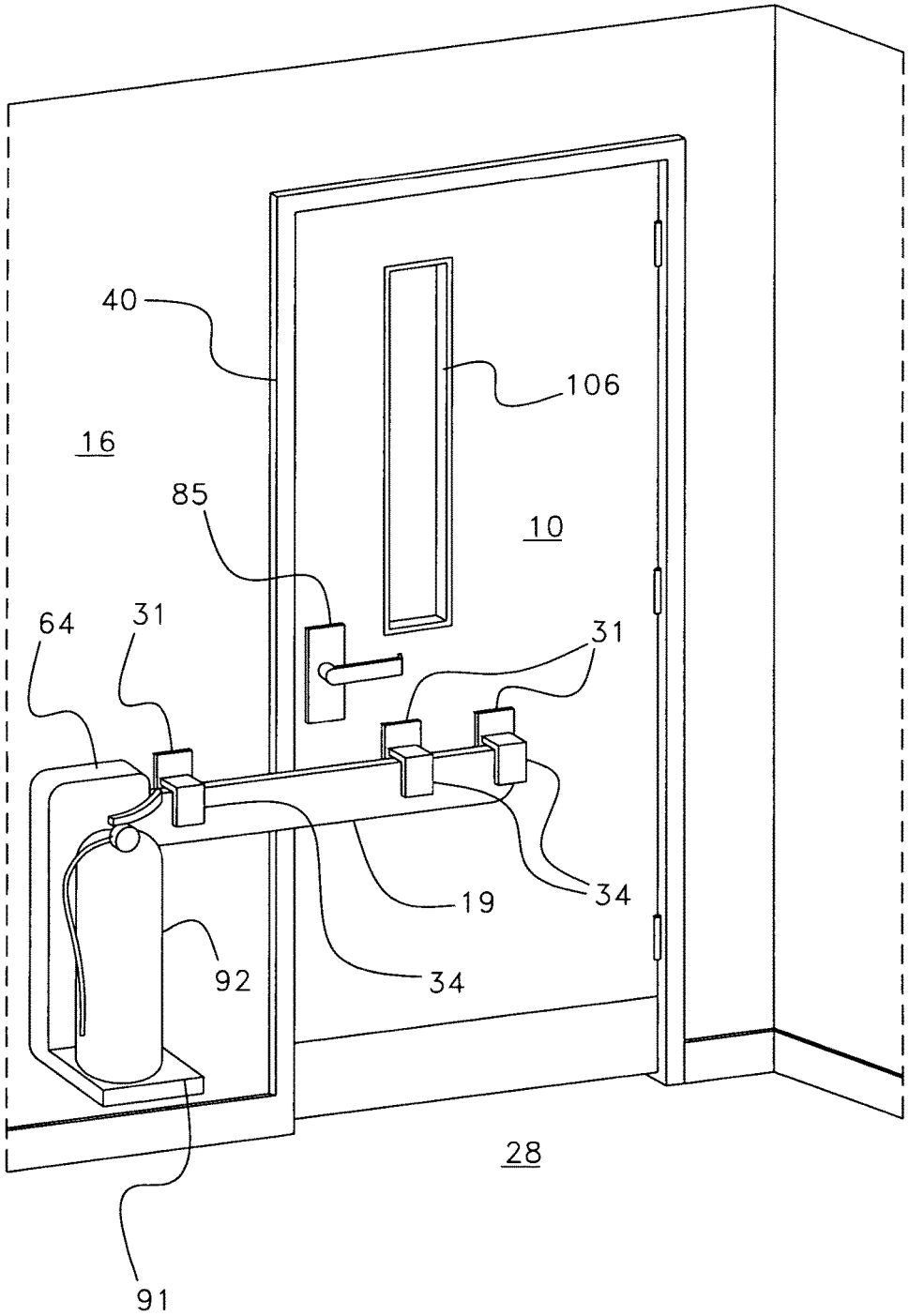
FIG. 15*a* shows a fire extinguisher supported by a ledge.
Figure 15B:
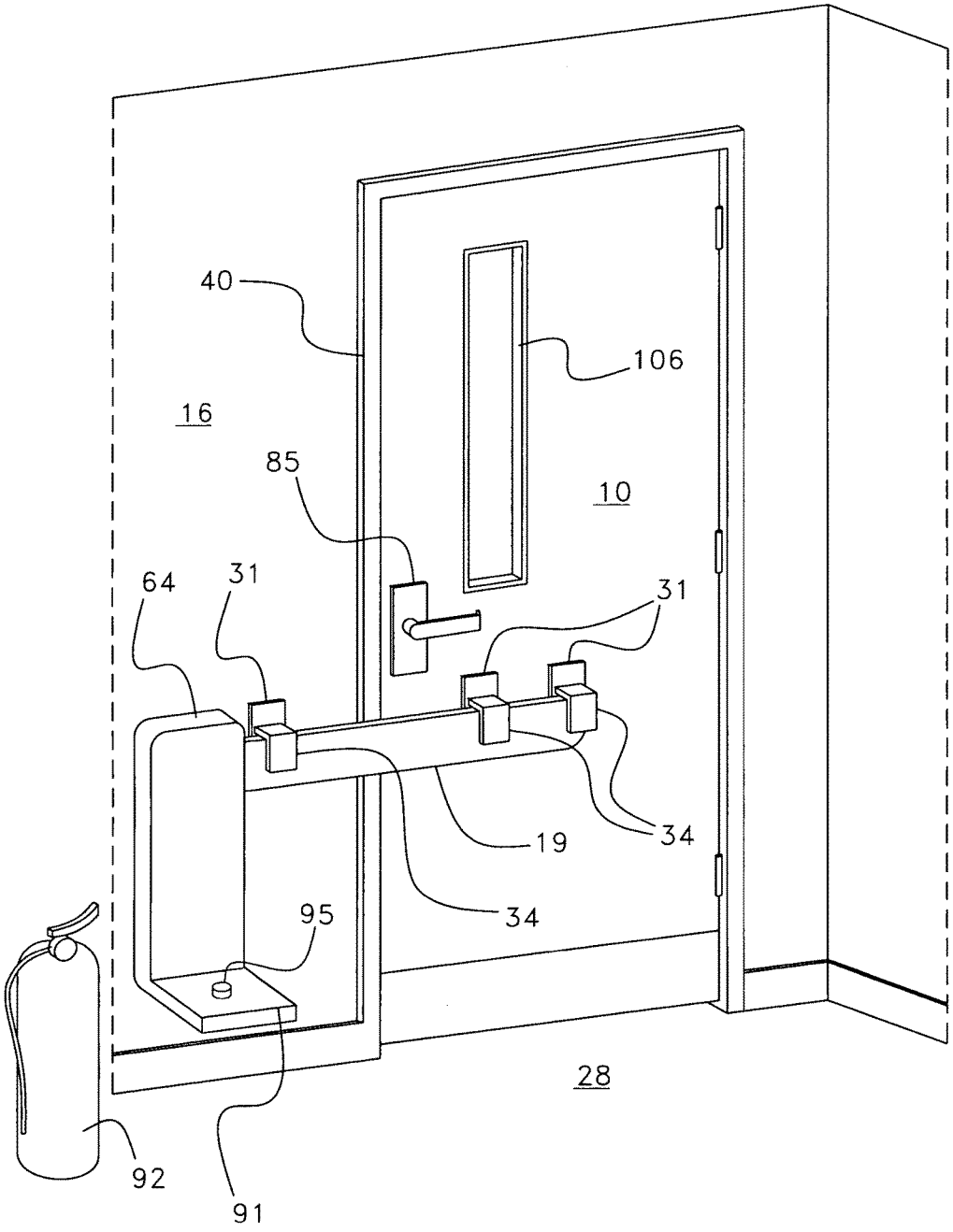
FIG. 15*b* shows the fire extinguisher removed from the ledge.

FIG. 14 shows a cover 64 that may be used with the barricade-device 13. The cover 64 may include a recessed edge 94 so that the arm 19 can move between the reserve-position and the barricade-position. The cover 64 may include a ledge 91 on which may be placed a fire extinguisher 92. FIG. 15*a* shows a fire extinguisher 92 on the ledge 91. When the fire extinguisher 92 is removed (see FIG. 15*b*) from the ledge 91, an alarm may be activated. The alarm may be triggered by a sensor that detects the removal of the fire extinguisher 92. In this manner, a person desiring to use the fire extinguisher 92 need not concern himself with finding a fire alarm to summon the fire department, break glass, or open a cabinet door in order to gain access to the fire extinguisher 92.

In the case of an alarm that is triggered by the removal of the fire extinguisher, a switch may be provided. One such switch may utilize a spring-biased button 95 (see FIG. 15*b*) and a pair of conductive contacts. The weight of the fire extinguisher on the button 95 keeps the button 95 depressed, but when the fire extinguisher is removed, the spring causes the button 95 to move, and this movement of the button 95 is sensed, and the alarm is consequently triggered. For example, the button 95 may be associated with a pair of electrical contacts that touch each other when the fire extinguisher keeps the button 95 depressed. As long as the electrical contacts touch each other, electricity may flow through them. But, when the fire extinguisher is removed, the spring causes the button 95 to move, which separates the electrical contacts thereby causing the electricity to stop flowing, and this cessation of electricity flowing between the contacts is detected by a sensor that triggers the alarm. Alternatively, when the fire extinguisher is in place, the electrical contacts may be separated from each other and thus no electricity flows between the contacts, but movement of the spring-biased button 95 as a result of removing the fire extinguisher results in the electrical contacts coming into contact with each other, which in turn allows electricity to flow between the contacts, and the flowing electricity is then detected by a sensor that triggers the alarm. Other types of switches are possible, such as a magnetic switch that senses the presence of a magnetic material associated with the fire extinguisher, and when the fire extinguisher is removed, a sensor detects that the magnetic material is no longer present, which results in triggering of the alarm.

The barricade device may include an alarm that is triggered by a predetermined set of circumstances. One such circumstance, the removal of a fire extinguisher, is described above. There are other such circumstances. The alarm or alarm system may include an audible notification and/or a visual notification in order to warn people of a particular type of situation. For example, the alarm may be triggered when (a) the stop-device, and in particular the barricade arm, begins to move toward the barricade position, and/or (b) when the stop-device, and in particular the barricade arm, reaches the barricade position, and/or (c) (as noted above) when a fire extinguisher is removed from the door barricade.

When the movable stop-device 22 is in the barricade-position, it may be necessary for an authorized person, such as an emergency responder (e.g. firefighter or police officer) to enter the room. To permit an authorized person to enter the room from a side of the door 10 which does not have the movable stop-device 22, a release/override mechanism 97 may be provided. The release/override mechanism 97 may include a motor and battery having sufficient energy to move the stop-device 22 from the barricade-position to the reserve-position, or may be embodied as a switch that activates the motor 70 to move the stop-device 22. The release/override mechanism 97 causes the stop-device 22 to move to the reserve-position, thereby allowing the authorized person to open the door 10. When the release/override mechanism 97 is operated by an authorized person, the stop-device 22 moves from the barricade-position to the reserve-position, for example via the action of a spring, motor 70, gravity, or some combination of two or more forces applied to the stop-device 22.

Figure 16:
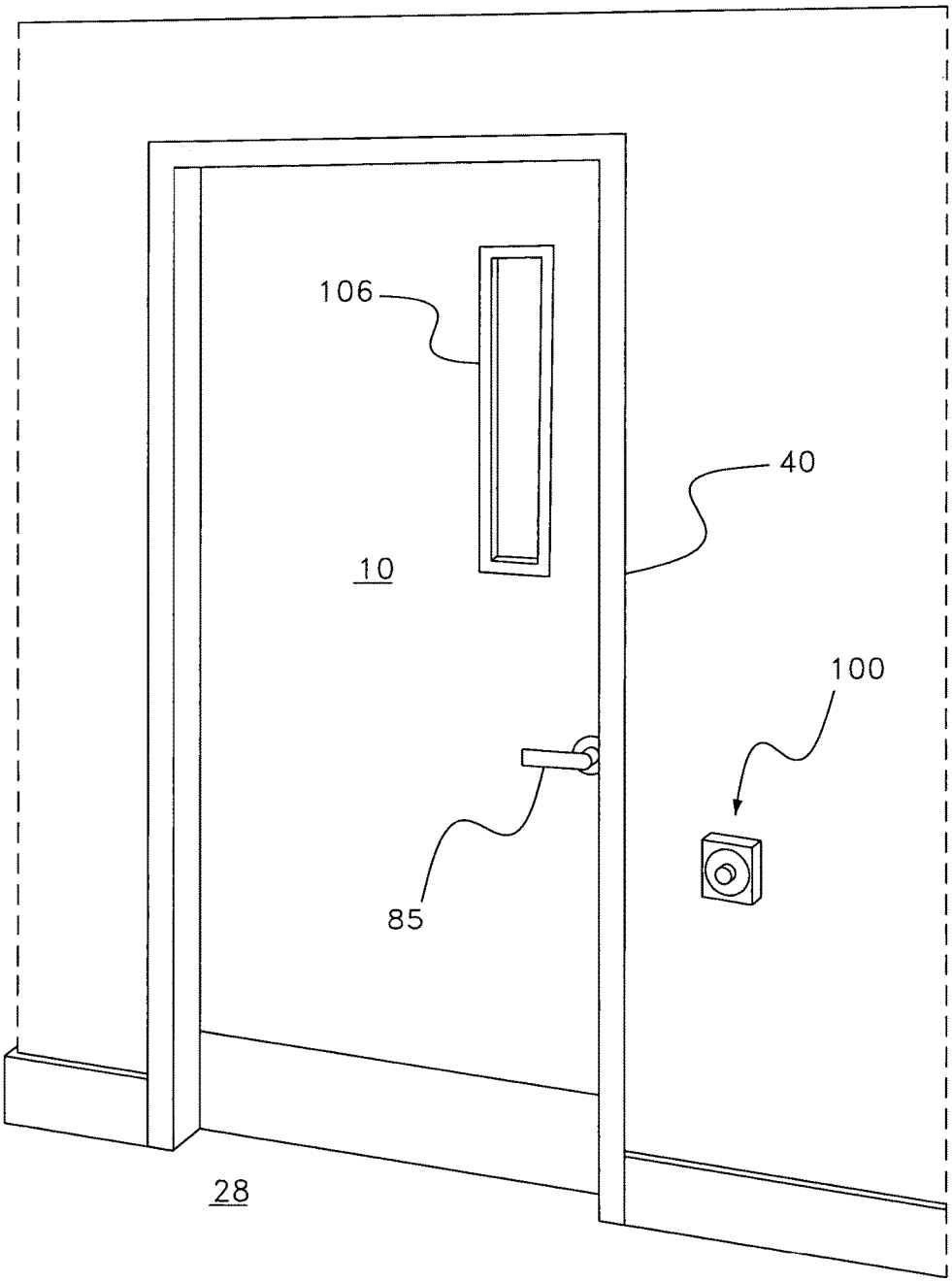
FIG. 16 depicts a side of a classroom door that is opposite to the side having the barricade-device.
Figure 17:
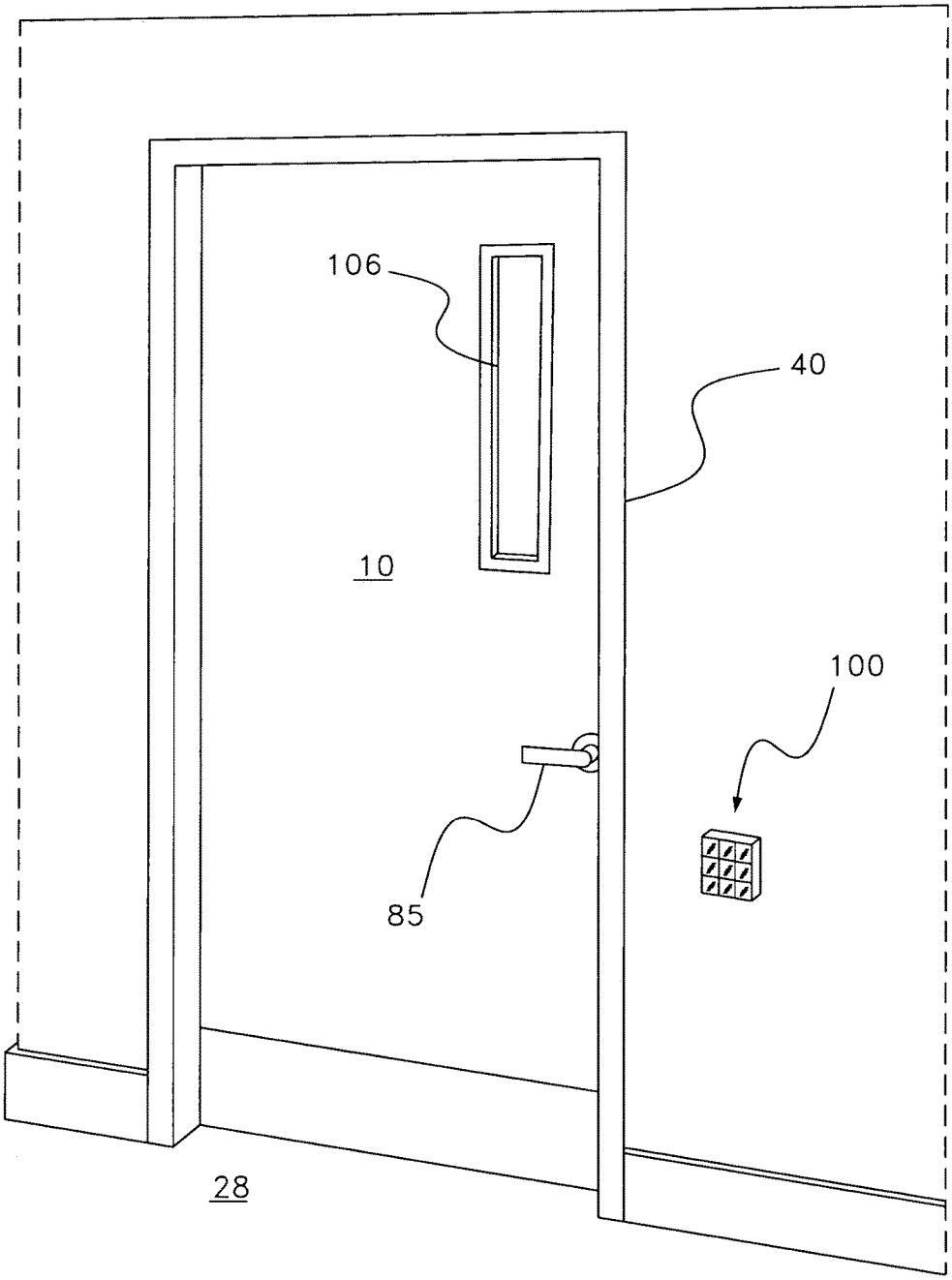
FIG. 17 depicts a side of a classroom door that is opposite to the side having the barricade-device.

The release/override mechanism 97 may include and be activated via an input device 100. FIGS. 16 and 17 show two types of input devices 100. In FIG. 16, the input device 100 accepts a key. An authorized person having the key activates the release/override mechanism 97 by inserting the key into the input device 100 (and optionally, turning the key). In FIG. 17, the input device 100 is a keypad. An authorized person having the proper code activates the release/override mechanism 97 by entering the code on the keypad. By using the key (FIG. 16) or entering a code to the keypad (FIG. 17), an authorized person outside the room can cause the stop-device 22 to move to the reserve-position so that the authorized person can open the door 10 and enter the room. For example, when equipped with a motor 70, activation of the release/override mechanism 97 may cause the motor 70 to move the stop-device 22 to the reserve-position. The input device 100 is not limited to those shown in FIGS. 16 and 17, and may include other input devices 100, such as a card-swipe scanner, biometric scanner (e.g. finger or retina). The input device 100 may be remotely located, such as in a fire command station.

Figure 18:
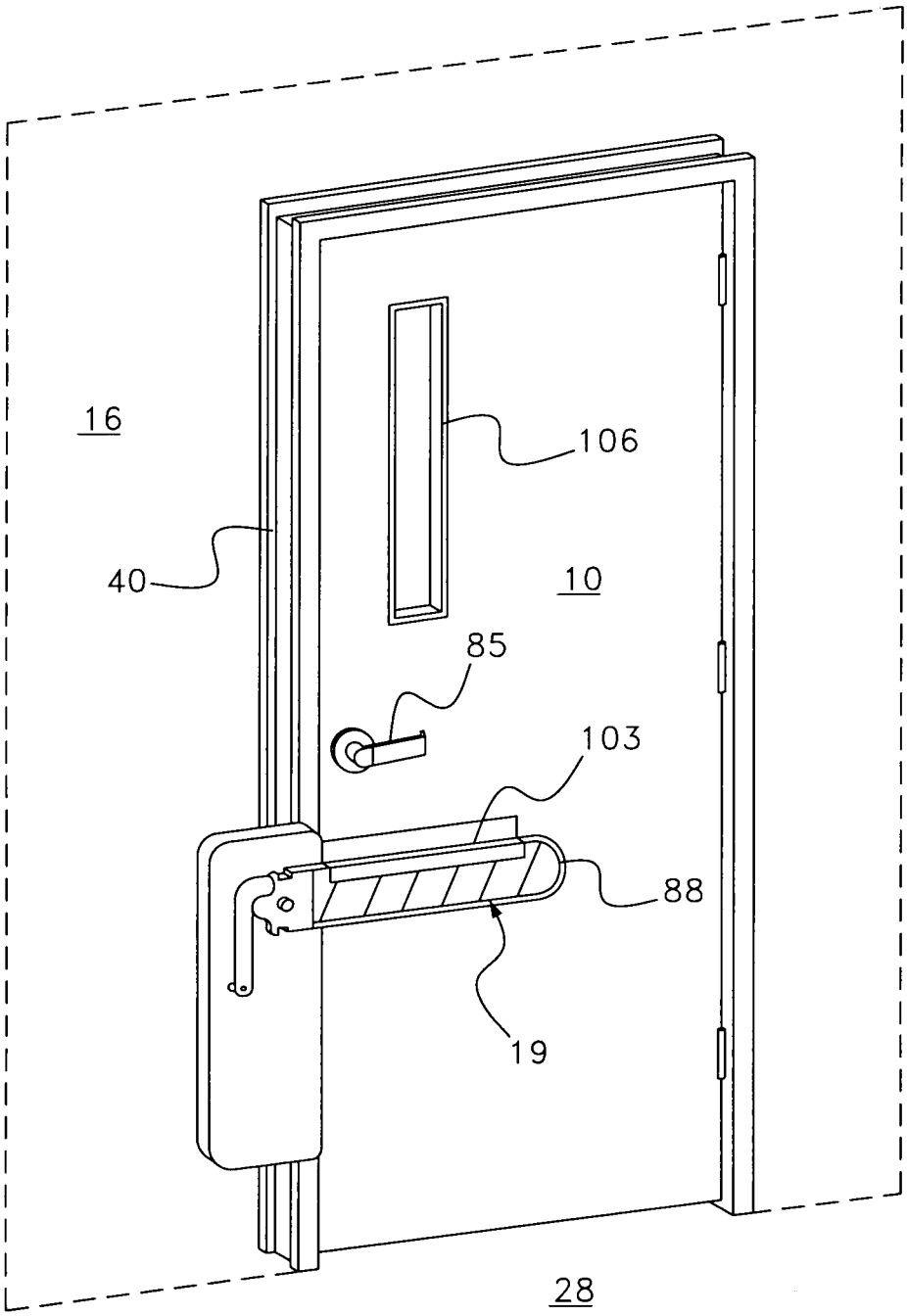
FIG. 18 depicts a barricade-device that includes a shield mounted to the door.

To prevent an intruder from moving the stop-device 22 to the reserve-position, a shield 103 may be provided. FIG. 18 depicts a shield 103 that is designed to prevent an intruder from moving the stop-device 22 by reaching through the window 106.

Figure 20:
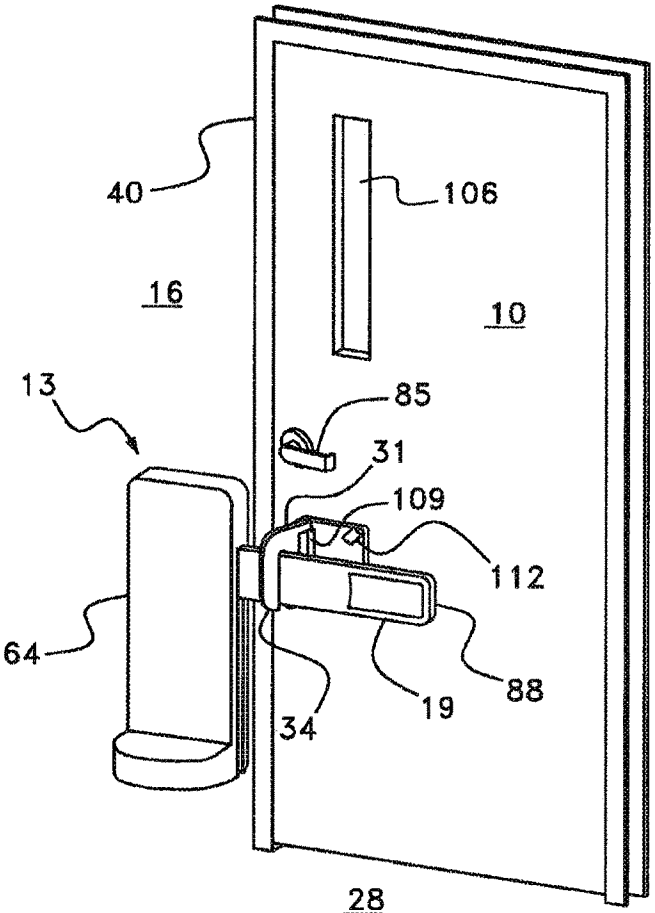
FIGS. 19 and 20 depict a barricade-device that includes a bracket that lays close to the door when the arm is not in the barricade-position, but extends away from the door when needed to overlap the arm of the stop-device.
Figure 19:
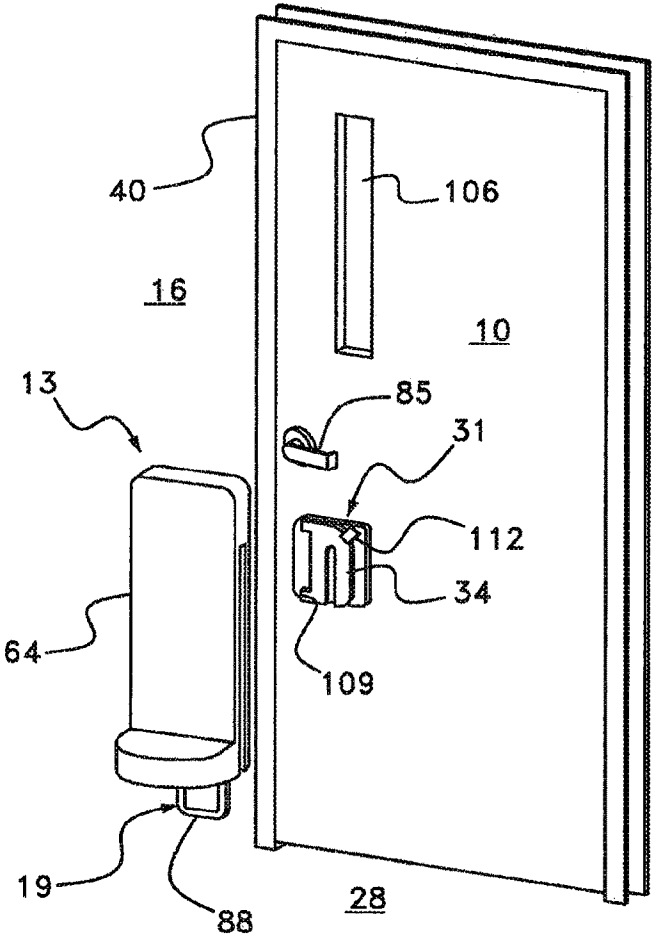

FIGS. 19 and 20 show a barricade-device 13 having a bracket 31 that lays against the door 10 when the arm 19 is not in the barricade-position. When the arm 19 moves toward the barricade-position, the bracket 31 moves to an extended-position in order receive and overlap the arm 19. Such a bracket 31 may be enabled to move to the extended-position by a spring-loaded hinge 109 and a remotely-activated latch 112 that releases the bracket 31 when the arm 19 moves toward the barricade-position. For example, the latch 112 may be released via a remotely-provided electromagnetic frequency. Such an arrangement may be useful where it is desired to have the bracket 31 not extend away from the door 10, except when there is a need to barricade the door 10. It is believed such an arrangement may be particularly useful for out-swinging doors 10 since the bracket 31 may need to extend further from the door 10 than in the situation where the door 10 is in-swinging.

Having described several embodiments of the invention, it will now be recognized that the invention may be embodied as a door barricade-device 13 that has a pivotable stop-device 22. The stop-device 22 may be pivotable about an axis 43 that is nearer to an edge of the door 10 where the door handle 85 and associated latching mechanism is located, than to an edge of the door 10 that is hinged to the door frame 40. The stop-device 22 may be comprised of an arm 19, and the arm 19 may be comprised of a bar 49 and an extension 61, and the extension 61 may be made of a durable, light-weight, plastic material. The stop-device 22 is pivotable from a location adjacent to the door 10, and the pivot location is at an elevation that is lower than a door handle 85 that is mounted on the door 10 and used to unlatch the door 10. The stop-device 22 is pivotable from a reserve-position to a barricade position. In moving from the reserve-position to the barricade-position, a distal-end 88 of the stop device 22 moves away from the floor 28 that is adjacent to the door 10. In the reserve-position, the stop-device 22 does not barricade the door 10. But, in the barricade-position, the stop-device 22 barricades the door 10. In the barricade position, the stop-device 22 need not span the width of the door 10 in order to barricade the door 10.

It will also be recognized that a bracket 31 may be included and positioned to overlap the stop-device 22 when the stop-device 22 is in the barricade-position. But, when the stop-device 22 is in the reserve position, the bracket 31 does not overlap the stop-device 22. The bracket 31 is oriented to receive the stop-device 22 as the stop-device 22 moves away from the floor 28 that is adjacent to the door 10.

Figure 21:
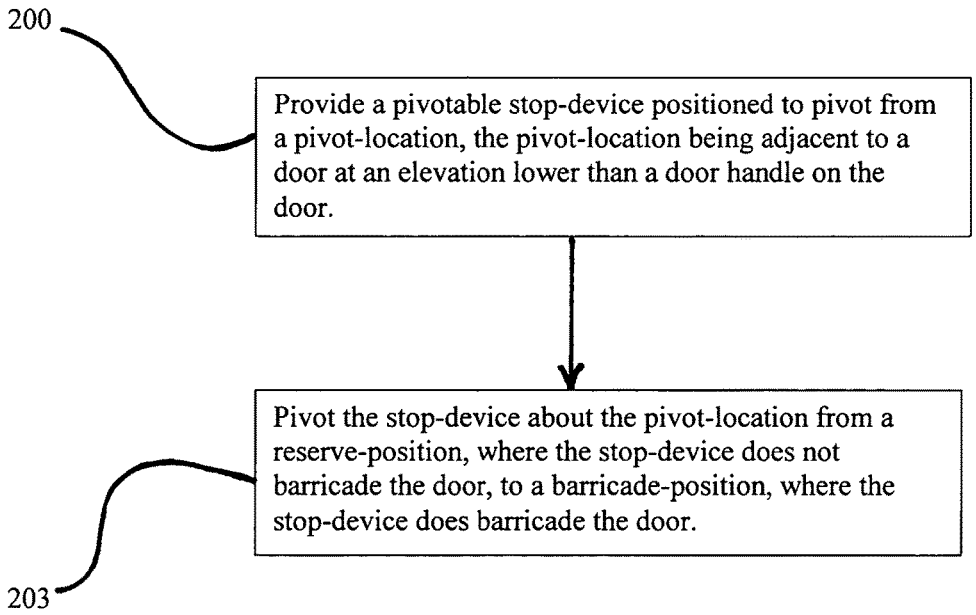
FIG. 21 is a flow chart depicting a method of barricading a door.

The invention may be embodied as a method of barricading a door. FIG. 21 depicts steps of a method for barricading a door. In that method, a pivotable stop-device (such as those described above) is provided 200 and positioned to pivot from a pivot-location. The pivot location is adjacent to the door, but preferably not on the door itself. For example the pivot-location may be coincident with a pivot axis that (if extended) would not traverse the door. Such a pivot axis may traverse (if extended) a wall adjacent to the door, or a frame surrounding the door. The pivot location is placed at an elevation from the floor that is lower than the elevation of a door handle on the door. The method includes pivoting 203 the stop-device about the pivot-location from a reserve-position, where the stop-device does not barricade the door, to a barricade-position, where the stop-device does barricade the door.

In keeping with the description above, a method may include providing a bracket that is positioned to overlap the stop-device when the stop-device is in the barricade-position, but not when the stop-device is in the reserve-position. And, in such a method, the step of pivoting 203 the stop-device includes the bracket receiving the stop-device as the stop-device moves away from the floor that is adjacent to the door.

Barricade devices and methods of barricading a door have been disclosed herein. Also disclosed are door assemblies, which include a door having a frame, a wall to which the frame is attached, and a barricade device. Such devices, methods, and assemblies may be used to barricade a door, and thereby prevent an intruder from entering a sheltering space, such as a classroom, storeroom, or hallway. The barricade-device may have a pivotable stop-device that is pivotable from a location adjacent to a door. The pivot-location may be at an elevation that is lower than a door handle on the door. The stop-device may be pivotable from a reserve-position to a stop-position. In the reserve-position, the stop-device does not barricade the door. In the barricade-position, the stop-device barricades the door. Operation of the barricade-device may require the use of one or more major muscle groups of the body, but need not require precise dexterity of the fingers or hands (e.g. such as that required to manipulate small keys, latches, and/or the grasping and turning of assemblies). As such, the barricade-device may be used properly and quickly by a wide range of people having differing physical and mental capabilities.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A door barricade, comprising a pivotable stop-device having a barricade arm, wherein the barricade arm is:

(i) pivotable about an axis that is:

(a) nearer to an edge of a door where a latching mechanism of the door is located than to an edge of the door where door hinges are located, and (b) at an elevation lower than an elevation of a door handle on the door; and (ii) pivotable about the axis from a reserve-position to a barricade position, wherein:

(a) in the reserve-position the barricade arm does not barricade the door and a free-end of the barricade arm is at a first elevation, (b) in the barricade-position the barricade arm does barricade the door and the free-end is at a second elevation;

wherein, the elevations are measured from a floor adjacent to the door; and wherein, the first elevation is less than the second elevation; and wherein, when the stop-device is in the barricade-position, the barricade arm does not span the width of the door.

2. The door barricade of claim 1, further comprising a bracket positioned to overlap the barricade arm when the stop-device is in the barricade-position, but not when the stop-device is in the reserve-position.

3. The door barricade of claim 2, wherein the bracket is oriented to overlap the barricade arm as the barricade arm moves away from the floor adjacent to the door.

4. The door barricade of claim 2, wherein the bracket is mounted to a wall adjacent to the door.

5. The door barricade of claim 2, wherein the bracket is mounted to the door.

6. The door barricade of claim 1, wherein the location is adjacent to the door.

7. The door barricade of claim 1, wherein the free-end of the barricade arm moves away from the floor adjacent to the door when the stop-device moves toward the barricade-position from the reserve-position.

8. The door barricade of claim 1, wherein not more than three pounds of force applied to the free-end of the barricade arm is required in order to move the stop-device to the barricade-position.

9. The door barricade of claim 1, further comprising a motor capable of providing a force to move the stop-device to the barricade-position.

10. The door barricade of claim 9, further comprising a linkage system selectively connecting the motor with the stop-device, the linkage system including a disengaging mechanism, wherein the disengaging mechanism disengages the motor from the stop-device when the motor lacks the ability unable to move the stop-device, and thereby permits moving the stop-device without moving the motor.

11. The barricade-device of claim 10, wherein the linkage system includes a chain to transfer force from the motor to the stop-device.

12. The barricade-device of claim 10, wherein the linkage system includes a gear to transfer a force from the motor to the stop-device.

13. The door barricade of claim 9, wherein not more than three pounds of force applied to the free-end of the barricade arm is required in order to move the stop-device to a position in which the motor will then move the stop-device to the barricade-position.

14. The barricade-device of claim 9, wherein the motor is powered by electricity.

15. The barricade-device of claim 14, wherein the electricity is supplied by a battery.

16. The barricade-device of claim 1, wherein the barricade arm is pivotable to rotate about an axis that is substantially perpendicular to a wall adjacent to the door.

17. The barricade-device of claim 1, wherein the barricade arm is positioned to rotate about an axis, which, if extended, would traverse a wall adjacent to the door.

18. The barricade-device of claim 1, further comprising:

a cover having a ledge;

a fire extinguisher positioned on the ledge; and an alarm that is activated when the extinguisher is removed from the ledge.

19. The barricade-device of claim 1, further comprising a release-override mechanism that is used to move the stop-device from the barricade-position to the reserve-position, the release/override mechanism being operable by an authorized person who is prevented from opening the door when the stop-device is in the barricade-position.

20. The barricade-device of claim 1, further comprising a release-override mechanism that is used to allow the stop-device to move from the barricade-position to the reserve-position, the release/override mechanism being operable by an authorized person who is prevented from opening the door when the stop-device is in the barricade-position.

21. The barricade-device of claim 1, wherein the barricade arm includes a metal bar and a plastic extension.

22. The barricade-device of claim 1, further comprising an alarm that is activated when the stop-device moves from the reserve-position toward the barricade-position.

23. The barricade-device of claim 22, wherein the alarm includes at least one of an audible notification or a visual notification.

24. The barricade-device of claim 1, further comprising a shield preventing access to the barricade arm by an intruder when the stop-device is in the barricade-position.

* * * * *